US010962257B2

(12) United States Patent
Frechette et al.

(10) Patent No.: US 10,962,257 B2
(45) Date of Patent: Mar. 30, 2021

(54) COMPACT FLUID HEATING SYSTEM WITH HIGH BULK HEAT FLUX USING ELEVATED HEAT EXCHANGER PRESSURE DROP

(71) Applicant: FULTON GROUP N.A., INC., Pulaski, NY (US)

(72) Inventors: Alexander Thomas Frechette, Mexico, NY (US); Carl Nicholas Nett, Sandisfield, MA (US); Thomas William Tighe, Pulaski, NY (US); Keith Richard Waltz, Sandy Creek, NY (US)

(73) Assignee: FULTON GROUP N.A., INC., Pulaski, NY (US)

( * ) Notice: Subject to any disclaimer, the term of this patent is extended or adjusted under 35 U.S.C. 154(b) by 302 days.

(21) Appl. No.: 16/010,112

(22) Filed: Jun. 15, 2018

(65) Prior Publication Data

US 2018/0292106 A1 Oct. 11, 2018

Related U.S. Application Data

(63) Continuation-in-part of application No. 15/374,169, filed on Dec. 9, 2016, now Pat. No. 10,612,816.

(Continued)

(51) Int. Cl.
*F24H 1/14* (2006.01)
*F22B 37/10* (2006.01)

(Continued)

(52) U.S. Cl.
CPC ..... *F24H 1/145* (2013.01); *F22B 3/04* (2013.01); *F22B 37/104* (2013.01); *F24H 1/206* (2013.01);

(Continued)

(58) Field of Classification Search
CPC ..... F24H 1/145
See application file for complete search history.

(56) References Cited

U.S. PATENT DOCUMENTS 3,942,355 A * 3/1976 McInerney ..... F24H 1/165 374/45
4,090,362 A * 5/1978 Bourque ..... F01K 7/02 60/653

(Continued)

FOREIGN PATENT DOCUMENTS

CN 101709875 A 5/2010
EP 0 580 418 A1 1/1994
WO 2006058542 A2 6/2006

OTHER PUBLICATIONS

International Search Report for International Application No. PCT/US2016/065870 dated Mar. 27, 2017.

(Continued)

*Primary Examiner* — Nathaniel Herzfeld
(74) *Attorney, Agent, or Firm* — McCormick, Paulding & Huber PLLC

(57) ABSTRACT

A fluid heating system for heating a production fluid using a thermal transfer fluid, the production fluid being contained in a vessel includes an electric blower configured to receive ambient air and electrical input power and to provide output source air, a combustion system configured to receive the source air from the electric blower and to receive fuel and to provide the thermal transfer fluid, a heat exchanger configured to receive the thermal transfer fluid from the combustion system and configured to be in thermal communication with the production fluid to provide convective heat exchange from the thermal transfer fluid to the production fluid, and to provide output exhaust gas, and wherein the electric fan provides a predetermined volume flow rate of the output source air at a predetermined blower efficiency (Continued)

such that the fluid heating system has a Bulk Heat Flux of at least about 14.7 kBTU/Hr/ft$^2$ and a Pressure Drop of at least about 0.7 psi.

19 Claims, 16 Drawing Sheets

Related U.S. Application Data

(60) Provisional application No. 62/264,934, filed on Dec. 9, 2015.

(51) Int. Cl.

| | |
|---|---|
| ***F24H 1/20*** | (2006.01) |
| ***F24H 9/00*** | (2006.01) |
| ***F22B 3/04*** | (2006.01) |
| ***F24H 1/28*** | (2006.01) |
| *F28D 21/00* | (2006.01) |
| *F28D 7/00* | (2006.01) |
| *F28D 7/16* | (2006.01) |
| *F28D 7/10* | (2006.01) |

(52) U.S. Cl.

CPC ..... *F24H 1/207* (2013.01); *F24H 1/287* (2013.01); *F24H 9/0021* (2013.01); *F24H 9/0031* (2013.01); *F28D 7/0066* (2013.01); *F28D 7/103* (2013.01); *F28D 7/16* (2013.01); *F28D 7/163* (2013.01); *F28D 21/0007* (2013.01); *F28D 2021/0024* (2013.01)

(56) References Cited

U.S. PATENT DOCUMENTS

| | | | | |
|---|---|---|---|---|
| 4,993,367 | A | 2/1991 | Kehrer | |
| 5,022,379 | A | 6/1991 | Wilson, Jr. | |
| 5,056,501 | A | 10/1991 | Ida | |
| 5,065,736 | A | 11/1991 | Mutchler | |
| 5,495,829 | A * | 3/1996 | Jayaraman | F24H 1/205 122/110 |
| 6,125,794 | A | 10/2000 | Joshi et al. | |
| 6,675,746 | B2 | 1/2004 | Gerstmann et al. | |
| 2003/0005892 | A1* | 1/2003 | Baese | F23D 14/02 122/448.1 |
| 2008/0173261 | A1 | 7/2008 | Cross | |
| 2011/0011069 | A1 | 1/2011 | Umeno | |
| 2013/0075064 | A1 | 3/2013 | Fetcu | |
| 2014/0326197 | A1 | 11/2014 | Deivasigamani et al. | |
| 2015/0233578 | A1* | 8/2015 | Monteiro | F23N 3/082 431/12 |
| 2016/0169552 | A1 | 6/2016 | Nett et al. | |

OTHER PUBLICATIONS

Written Opinion for International Application No. PCT/US2016/065870 dated dated Mar. 27, 2017.

* cited by examiner

COMPACT FLUID HEATING SYSTEM WITH HIGH BULK HEAT FLUX USING ELEVATED HEAT EXCHANGER PRESSURE DROP

CROSS-REFERENCE TO RELATED APPLICATIONS

This application is a continuation-in-part of U.S. patent application Ser. No. 15/374,169, filed Dec. 9, 2016, which claims priority to U.S. Provisional Patent Application Ser. No. 62/264,934, filed Dec. 9, 2015, each of which is hereby incorporated by reference in its entirety.

BACKGROUND

Field

This application relates to a compact fluid heating system with enhanced heat exchanger bulk heat flux.

Description of Related Art

Fluid heating systems are used to provide a heated production fluid for a variety of commercial, industrial, and domestic applications such as hydronic, steam, and thermal fluid boilers, for example. Because of the desire for improved energy efficiency, compactness, reliability, and cost reduction, there remains a need for an improved fluid heating system, as well as improved methods of manufacture thereof.

SUMMARY

Provided is a fluid heating system including: a pressure vessel including a first inlet and first outlet and an inside and an outside; an assembly including: a heat exchanger core including a second inlet and a second outlet, and an inner surface and an outer surface, wherein the heat exchanger core is inside the pressure vessel; a first conduit having a first end connected to the second inlet of the heat exchanger core and a second end disposed outside of the pressure vessel; a second conduit having a first end connected to the second outlet of the heat exchanger core and a second end disposed outside of the pressure vessel; and a blower in fluid connection with the first conduit, the blower configured for forcing a gas under pressure through the assembly; wherein the heat exchanger core further includes a flow passage between the second inlet and the second outlet, wherein the flow passage is configured to contain a thermal transfer fluid; wherein the fluid heating system satisfies the condition that a Bulk Heat Flux between the first end of the first conduit and the first end of the second conduit is between 45 $kW/m^2$ and 300 $kW/m^2$ wherein Bulk Heat Flux is determined by dividing the Gross Output by the Total Heating Surface Area where the Gross Output is determined in accordance with Section 11.1.12 of the *BTS*-2000 *Testing Standard, Method to Determine Efficiency of Commercial Heating Boilers*, published by The Hydronics Institute Division of AHRI, Second Edition, Rev. 06.07, Copyright 2007 (herein referred to as "AHRI BTS-2000"), and the Total heated Surface Area is calculated by summing all of the heat transfer surfaces that are directly exposed to thermal transfer fluid, and wherein the Pressure Drop between the first end of the first conduit and the first end of the second conduit is between 3 kiloPascals and 30 kiloPascals.

Also provided is method of heat transfer, the method including: providing a fluid heating system including a pressure vessel comprising an inside and an outside and a first inlet and a first outlet; a heat exchanger core comprising a second inlet and a second outlet, wherein the heat exchanger core is inside the pressure vessel; a first conduit having a first end connected to the second inlet of the heat exchanger core and a second end disposed outside of the pressure vessel; a second conduit having a first end connected to the second outlet of the heat exchanger core and a second end disposed outside of the pressure vessel; a blower disposed in the first conduit; and disposing a thermal transfer fluid in the heat exchanger core and a production fluid between the inside of the pressure vessel and the heat exchanger core to transfer heat from the thermal transfer fluid to the production fluid wherein the fluid heating system has a Bulk Heat Flux between the first end of the first conduit and the first end of the second conduit between 45 kW/m2 and 300 kW/m2 wherein Bulk Heat Flux is determined by dividing the Gross Output by the Total Heated Surface Area where the Gross Output is determined in accordance with Section 11.1.12 of the AHRI BTS-2000, and the Total heated Surface Area is calculated by summing all of the heat transfer surfaces that are directly exposed to thermal transfer fluid, and wherein the Pressure Drop between the first end of the first conduit and the first end of the second conduit is between 3 kiloPascals and 30 kiloPascals.

A method of manufacturing a fluid heating system, the method including: providing a pressure vessel including a first inlet and a first outlet and an inside and an outside; disposing a heat exchanger core entirely in the pressure vessel, the heat exchanger core including a second inlet and a second outlet; connecting the second inlet of the heat exchanger core to a first conduit, which extends outside the pressure vessel; and connecting the second outlet of the heat exchanger core to a second conduit, which extends outside the pressure vessel is provided.

A fluid heating system including: a pressure vessel including a first inlet and first outlet and an inside and an outside, wherein the pressure vessel is configured to contain a production fluid including liquid water, steam, a C1 to C10 hydrocarbon, a thermal fluid, a thermal oil, a glycol, air, carbon dioxide, carbon monoxide, or a combination thereof; a tube heat exchanger core including a first tube sheet, a second tube sheet, a plurality of heat exchanger tubes, each heat exchanger tube independently connecting the first tube sheet and the second tube sheet, a second inlet disposed on the first tube sheet, a second outlet disposed on the second tube sheet, wherein the first inlet and second outlet define a flow passage, and wherein the tube heat exchanger core is configured to contain a gas phase thermal transfer fluid in the flow passage of the heat exchanger core, wherein the thermal transfer fluid comprises water, a substituted or unsubstituted C1 to C30 hydrocarbon, air, carbon dioxide, carbon monoxide, combustion byproducts, a thermal fluid, a thermal oil, a glycol or a combination thereof; a first conduit having a first end connected to the second inlet of the heat exchanger core and a second end disposed outside of the pressure vessel; a second conduit having a first end connected to the second outlet of the heat exchanger core and a second end disposed outside of the pressure vessel; and a blower for forcing the thermal transfer fluid under pressure through an assembly including the first conduit, the heat exchanger and the second conduit wherein the blower is in fluid communication with the first conduit, the first conduit further comprises a burner assembly and a furnace assembly disposed in the first conduit; wherein the fluid heating system satisfies the condition that a Bulk Heat Flux between the first end of the first conduit and the first end of the second conduit is between 47 kW/m$^2$ and 120 kW/m$^2$ wherein Bulk Heat Flux is determined by dividing the Gross Output by the Total Heating Surface Area where the Gross Output is determined in accordance with Section 11.1.12 of the AHRI BTS-2000, and the Total heated Surface Area is calculated by summing all of the heat transfer surfaces that are directly exposed to thermal transfer fluid, and wherein the Pressure Drop between the first end of the first conduit and the first end of the second conduit is between than 3 kiloPascals and 12 kiloPascals is provided.

A fluid heating system including: a pressure vessel including a first inlet and first outlet and an inside and an outside, wherein the pressure vessel is configured to contain a production fluid including liquid water, steam, a C1 to C10 hydrocarbon, a thermal fluid, a thermal oil, a glycol, air, carbon dioxide, carbon monoxide, or a combination thereof; a tubeless heat exchanger core including a top head, a bottom head, an inner casing disposed between the top head and the bottom head, the inner casing including an inner surface, an outer casing disposed between the top head and the bottom head and opposite the inner surface of the inner casing, a first inlet and a second inlet on the inner casing, the outer casing, or a combination thereof, and a first outlet and a second outlet on the inner casing, the outer casing, or combination thereof, wherein at least one of the inner casing and the outer casing comprises a rib, a ridge, a spine or a combination thereof, wherein the inner casing and the outer casing define a flow passage between the inlet and the outlet of the tubeless heat exchanger core, and wherein the flow passage is configured to contain a gas phase thermal transfer fluid in the flow passage of the heat exchanger core, wherein the thermal transfer fluid comprises water, a substituted or unsubstituted C1 to C30 hydrocarbon, air, carbon dioxide, carbon monoxide, combustion byproducts, a thermal fluid, a thermal oil, a glycol or a combination thereof; a first conduit having a first end connected to the second inlet of the heat exchanger core and a second end disposed outside of the pressure vessel; a second conduit having a first end connected to the second outlet of the heat exchanger core and a second end disposed outside of the pressure vessel; and a blower for forcing the gas phase thermal transfer fluid under pressure through the first conduit, the heat exchanger and the second conduit wherein the blower is in fluid communication with the first conduit the first conduit further comprises a burner assembly disposed in the first conduit and the first conduit further comprises a furnace assembly disposed in the first conduit; wherein the fluid heating system satisfies the condition that a Bulk Heat Flux between the first end of the first conduit and the first end of the second conduit is between 47 kW/m$^2$ and 120 kW/m$^2$ wherein Bulk Heat Flux is determined by dividing the Gross Output by the Total Heating Surface Area where the Gross Output is determined in accordance with Section 11.1.12 of the AHRI BTS-2000, and the Total heated Surface Area is calculated by summing all of the heat transfer surfaces that are directly exposed to thermal transfer fluid, and wherein the Pressure Drop between the first end of the first conduit and the first end of the second conduit is between 3 kiloPascals and 12 kiloPascals is provided.

BRIEF DESCRIPTION OF THE DRAWINGS

The above and other advantages and features of this disclosure will become more apparent by describing in further detail exemplary embodiments thereof with reference to the accompanying drawings where like numbers indicate like elements.

DETAILED DESCRIPTION

Fluid heating systems are desirably thermally compact, provide a high ratio between the thermal output and the total size of the fluid heating system, and have a design which can be manufactured at a reasonable cost. This is particularly true of hydronic (e.g., liquid water), steam, and thermal fluid heating systems designed to deliver a heated production fluid, such as steam, for temperature regulation, domestic hot water, or commercial or industrial process applications. In a fluid heating system, a thermal transfer fluid comprising, e.g., a hot combustion gas, is generated by combustion of a fuel, and then the heat is transferred from the thermal transfer fluid to the production fluid using a heat exchanger.

The inventors hereof have developed a high pressure boiler system that increases the heat transfer coefficient by raising the airspeed through the heat exchanger and decreases the width of the turbulent boundary layer. This allows the heat exchanger to have less heat transfer surface area. The disclosed configuration provides unexpectedly improved efficiency and compactness compared with conventional approaches.

Figure 1A:
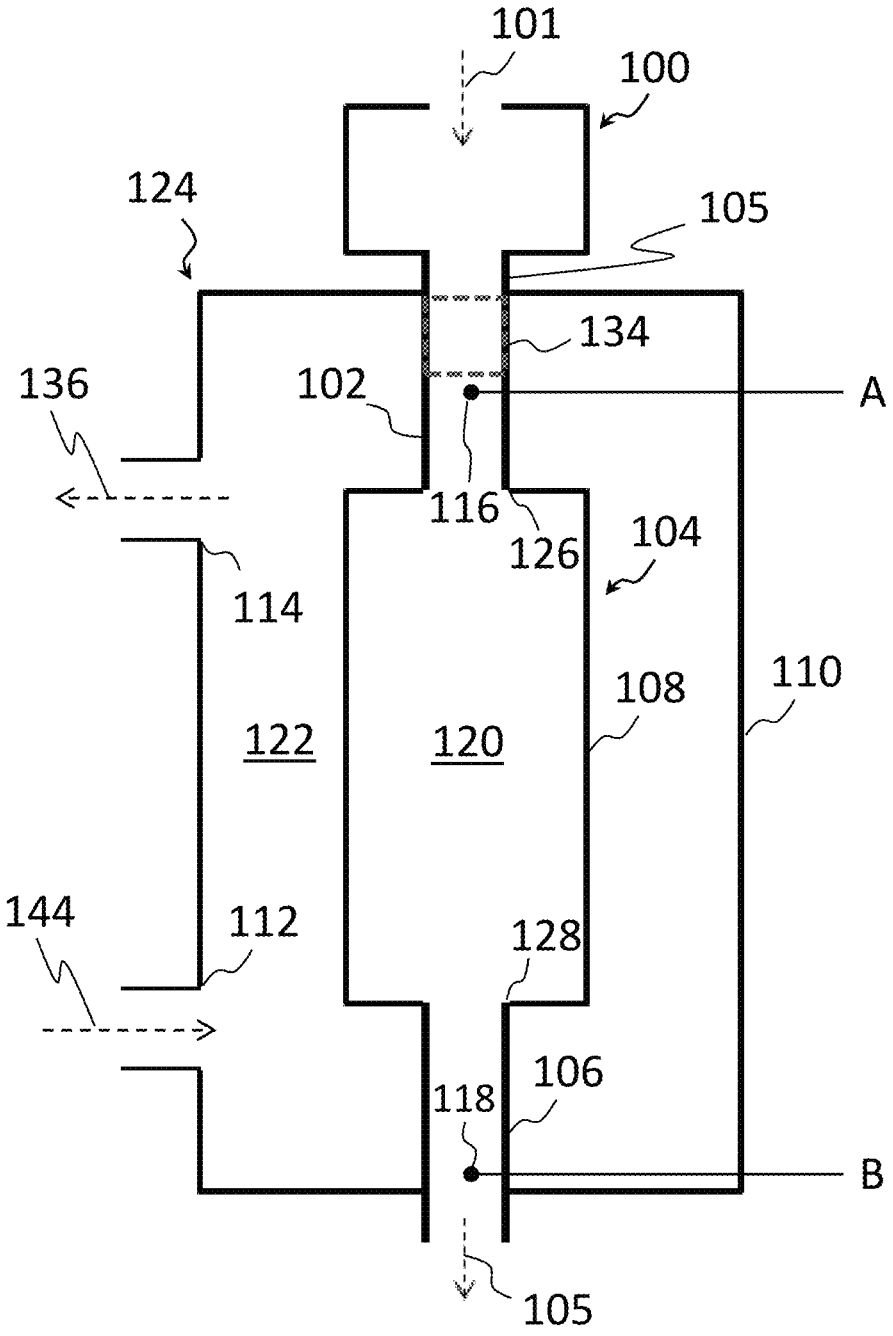
FIG. 1A is a diagram of aspects of a fluid heating system including a heat exchanger and illustrating the Pressure Drop measurement points used herein in accordance with embodiments of the present disclosure.

Shown in FIG. 1A is a schematic of an embodiment of a fluid heating system in which a gaseous thermal transfer fluid is forced under pressure by a blower 100 through a first conduit 102 into the inlet 126 of a heat exchanger 104. Exhaust gas 120 from the heat exchanger is expelled through a heat exchanger outlet 128 into a second conduit 106. Production fluid is forced into the pressure vessel 124 through an inlet 112 where it flows through the space 122 bounded by the pressure vessel 110 surrounding the heat exchanger 108 and exits through an outlet 114.

Thermal heat energy is transferred from the gas flowing through the gas path assembly comprising the first conduit 102, heat exchanger 104 and second conduit 106 to the production fluid flowing through the pressure vessel 124, across the Heating Surfaces. Heating Surfaces are those surfaces that have one face in contact with the thermal transfer fluid and another face in contact with the production fluid where augmented surfaces (e.g., fins) on the thermal transfer fluid side are included. Total heated Surface Area is calculated by summing all of the heat transfer surfaces that are directly exposed to thermal transfer fluid. For example, in the embodiment shown in FIG. 1A, the heating surfaces include 108.

The components comprising the thermal fluid flow path, including the heat exchanger, and the production fluid flow path, including the pressure vessel, can each independently comprise any suitable material, and can be a metal such as iron, aluminum, magnesium, titanium, nickel, cobalt, zinc, silver, copper, or an alloy comprising at least one of the foregoing. Representative metals include carbon steel, mild steel, cast iron, wrought iron, stainless steel (e.g., 304, 316, or 439 stainless steel), Monel, Inconel, bronze, and brass. Specifically provided is an embodiment in which the heat exchanger core, the pressure vessel, and the components comprising the gas flow path are mild or stainless steel.

Although Applicants do not intend to be bound by any theory presented here, it is believed thermal heat energy is transferred from the thermal transfer fluid to the production fluid across the Heating Surfaces by three heat transfer mechanisms: conduction, convection, and radiation. While the rate of heat transfer across the Heating Surfaces by conduction and radiation are inherently limited by both the properties of the construction materials and the chosen fuel, the rate of convective heat transfer to the production fluid across the Heating Surfaces is significantly affected by the flow characteristics of the gaseous thermal transfer fluid traversing the gas path from the first conduit, through the heat exchanger and into the second conduit. In particular, the rate of convective heat transfer is higher for thermal transfer fluid flow with turbulent boundary layers along the Heating Surfaces than for laminar flows, and the heat transfer rate increases with increasing Nusselt number.

The capacity of the fluid heating system is the total heat transferred from the thermal transfer fluid to the production fluid under standard conditions. By convention, where the production fluid is liquid (e.g., water, thermal fluid or thermal oil) the capacity is expressed in terms of British thermal units per hour (BTU/hr); where the production fluid is wholly or partly gaseous or vapor (e.g., steam) the standard unit of measurement is expressed in boiler horsepower (BHP). In embodiments where the production fluid is liquid (e.g., water, thermal fluid or thermal oil), the capacity of the fluid heating system can be 100,000 BTU/hr to 50,000,000 BTU/hr, or 150,000 BTU/hr to 50,000,000 BTU/hr, or 200,000 BTU/hr to 40,000,000 BTU/hr, or 250,000 BTU/hr to 35,000,000 BTU/hr, or 300,000 BTU/hr to 30,000,000 BTU/hr, or 350,000 BTU/hr to 25,000,000 BTU/hr, or 400,000 BTU/hr to 20,000,000 BTU/hr, or 450,000 BTU/hr to 20,000,000 BTU/hr, or 500,000 BTU/hr to 20,000,000 BTU/hr, or 550,000 BTU/hr to 20,000,000 BTU/hr, or 600,000 BTU/hr to 20,000,000 BTU/hr, for example. The upper limit of capacity of the fluid heating system when the production fluid is liquid can be 50,000,000 BTU/hr, 40,000,000 BTU/hr, 30,000,000 BTU/hr, 20,000,000 BTU/hr, 15,000,000 BTU/hr, 14,000,000 BTU/hr, 13,000,000 BTU/hr, 12,000,000 BTU/hr, 10,000,000 BTU/hr, 9,000,000 BTU/hr, or 8,000,000 BTU/hr, for example. The lower limit of the capacity of the fluid heating system when the production fluid is liquid can be 100,000 BTU/hr, 150,000 BTU/hr, 200,000 BTU/hr, 250,000 BTU/hr, 300,000 BTU/hr, 350,000 BTU/hr, 400,000 BTU/hr, 450,000 BTU/hr, 500,000 BTU/hr, 550,000 BTU/hr, or 600,000 BTU/hr, for example The foregoing upper and lower bounds can be independently combined, preferably 300,000 BTU/hr to 20,000,000 BTU/hr.

In an embodiment where the production fluid is wholly or partly gaseous or vapor (e.g., steam), the capacity of the fluid heating system can be between 1.5 HP to 1,500 HP, or 2.0 HP to 1,200 HP, or 2.5 HP to1000 HP, or 3.0 HP to 900 HP, or 3.5 HP to 800 HP, or 4 HP to 800 HP, or 4.5 HP to 800 HP, or 5 HP to 1,500 HP, or 10 HP to 1,500 HP, or 15 HP to 1,500 HP, or 20 HP to 1,500 HP, or 25 HP to 1,500 HP, or 30 HP to 1,500 HP, for example. The upper limit of the capacity of the fluid heating system when the production fluid is wholly or partly gaseous or vapor can be 2,500 HP, 2,000 HP, 1,800 HP, 1,600 HP, 1,500 HP, 1,400 HP, 1,300 HP 1,200 HP, 1,100 HP, 1,000 HP, 900 HP, 800 HP, for example, or any other capacity determined by the specific fluid heating system footprint and weight requirements. The lower limit of the capacity of the fluid heating system when the production fluid is wholly or partly gaseous or vapor can be 1.5 HP, 2.0 HP, 2.5 HP, 3.0 HP, 3.5 HP, 4 HP, 5 HP, 10 HP, 15 HP, 20 HP, 25 HP, or 30 HP, for example The foregoing upper and lower bounds can be independently combined. Fluid heating system capacities of 10 HP to 1000 HP and 10 HP to 1,600 HP are specifically cited.

In an embodiment, the fluid heating system capacity where the production fluid is liquid (e.g., water, thermal fluid or thermal oil) is between 500,000 BTU/hr to 30,000,000 BTU/hr. In an embodiment, the fluid heating system capacity where the production fluid is liquid (e.g., water, thermal fluid or thermal oil) is between 700,000 BTU/hr to 1,000,000 BTU/hr. In an embodiment, the fluid heating system capacity where the production fluid is wholly or partly gaseous or vapor (e.g., steam) is between 2.5 HP to 800 HP. In an embodiment, the fluid heating system capacity where the production fluid is wholly or partly gaseous or vapor (e.g., steam) is between 3.5 HP, 4 HP, 5 HP, 10 HP, 15 HP, 20 HP, 25 HP, or 30 HP to 500 HP, or 600 HP, or 700 HP, or 800 HP, or 900 HP, or 1,000 HP, or 1,100 HP, or 1,200 HP, or 1,300 HP, or 1,400 HP or 1,600 HP, or 1,800 HP, or 2,000 HP.

Overall, the equation governing the heat transfer of the boiler operating in steady state is given by the equation, $Q=U\ A\ \Delta T_{LM}$, where Q is the heat transfer rate, Uis the heat transfer coefficient, A is the Heating Surface area, and $\Delta T_{LM}$ is the log-mean temperature difference between the thermal transfer fluid and production fluid on opposite sides of the Heating Surfaces.

In a preferred embodiment, the stream of hot gases across the Heating Surfaces is fully turbulent flow for all normal operating conditions, implying that the convective heat flux across the Heating Surfaces occurs across a fully turbulent boundary layer. The Nusselt number and thickness of that turbulent boundary layer, and the resulting Q, the heat transfer rate are affected by several factors, including the velocity of the gaseous thermal transfer fluid flow and the surface characteristics of the Heating Surface.

Increasing the heat transfer rate (or, equivalently, increasing the heat transfer efficiency) can be used to reduce the size, complexity, and cost of a compact fluid heating system. Two approaches are typically used to enhance the heat transfer rate, Q, in the equation $Q=U\ A\ \Delta T_{LM}$: The first involves increasing the effective Heating Surface area (A) over which the heat transfer occurs. This can be accomplished by increasing the number of heat transfer elements (e.g., number of tubes in a shell-and-tube heat exchanger), the dimensions of the heat transfer components (e.g., length of the heat exchanger elements), or augmenting the surface area with structural elements (e.g., "fins") specifically designed to promote heat transfer. The disadvantage to increasing the Heating Surface area is that it increases the volume, weight, material cost, and manufacturing complexity of the fluid heating system.

The second approach to increasing the heat transfer rate is to increase the heat transfer coefficient (U). An approach to increasing the heat transfer coefficient is by treating the Heating Surface by introducing surface features designed to promote turbulence in the boundary layer of the thermal transfer fluid (hot "gas-side" flow) over the Heating Surfaces. These surface treatments (e.g., corrugations and/or turbulators on the gas-side of the Heating Surface serve to increase Nusselt number of the turbulent boundary layer and increase the Heating Surface area. The disadvantage to incorporating corrugations and turbulators on the gas-side Heating Surface is that only a limited benefit can ultimately be realized on the heat transfer rate using this approach and, moreover, that surface treatments increase the fluid heating system material cost and manufacturing complexity.

In a first aspect of the disclosed described systems and methods, it has been discovered that use of a heat transfer assembly characterized by a high pressure drop, together with an energy efficient high pressure blower (equivalently, high fan power) can be used to enhance the heat transfer rate, Q, by increasing the heat transfer fluid velocity across the Heating Surfaces. The higher the fan power (equivalently, fan speed or fan pressure), the thinner the turbulent boundary layer and, hence, the more efficient the heat transfer from the combustion gas to the production fluid.

Figure 1B:
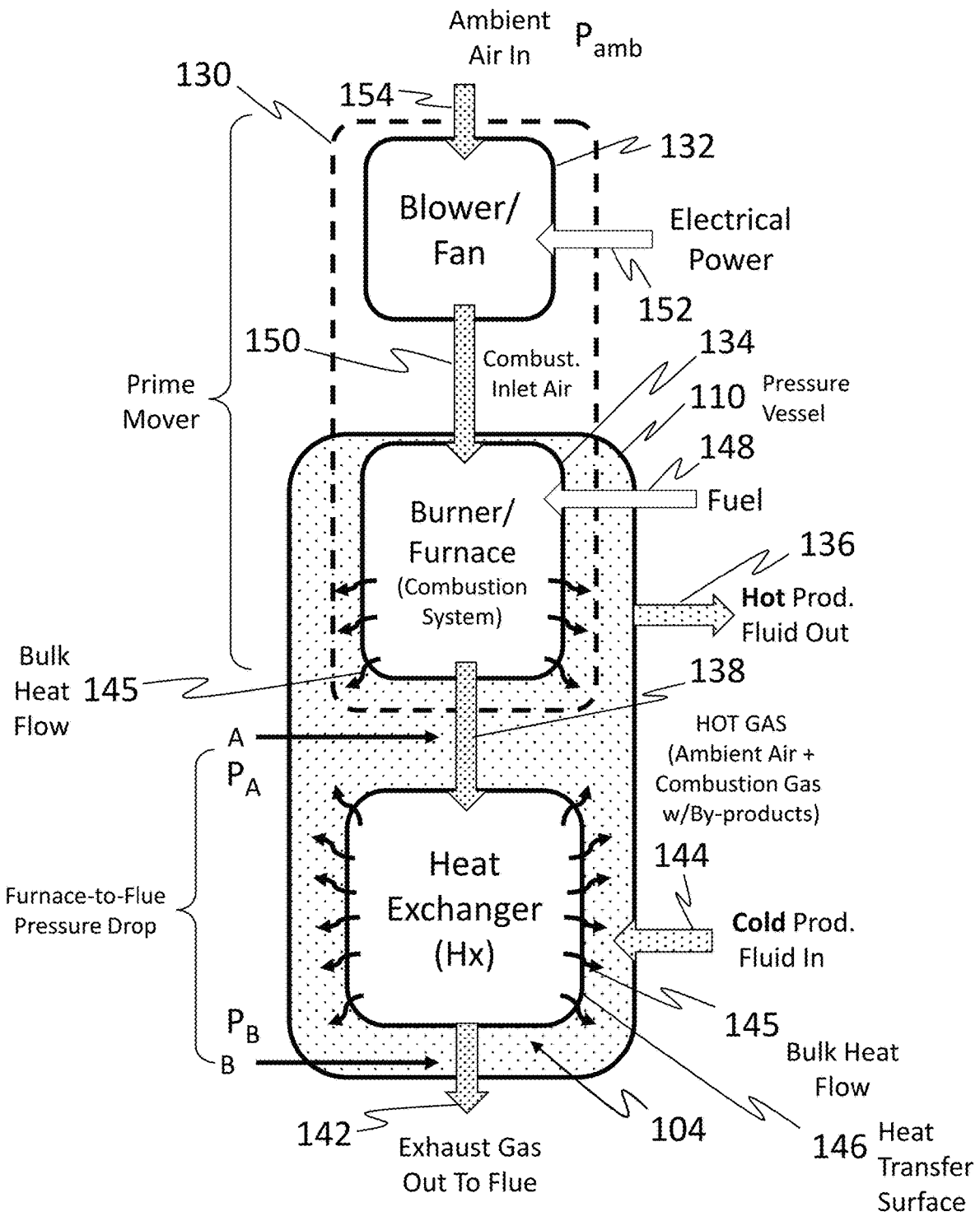
FIG. 1B is a diagram of functional aspects of a fluid heating system including a heat exchanger in accordance with embodiments of the present disclosure.

FIG. 1B shows a functional block diagram that illustrates the principles involved for an embodiment comprising an electric blower (alternatively, fan) and a petroleum fuel burner and furnace. Air at ambient temperature and pressure, $P_{amb}$, is directed 154 under pressure by a blower 132 utilizing electrical power 152 into a combustion system 134. The combustion system 134 utilizes fuel 148 (typically, natural gas or petroleum) and air under pressure from the blower 132 entering 150 the burner/furnace to ignite a fuel-air mixture in the burner within the furnace cavity. Heat energy released by the combustion process may be transferred 145 across the furnace wall surfaces to production fluid flowing into the production fluid inlet 144, through the pressure vessel 110 interior cavity, and flowing out of the pressure vessel through the production fluid outlet 136. The combination of the blower 132 and the combustion system 134 is referred to as the prime mover 130 which is designed to deliver a flowing mixture 138 of air and hot combustion gas to the heat exchanger 104.

The key functional characteristics of the prime mover may be described in terms of four measurable quantities: the fan pressure, volumetric flow rate, absorbed power and the efficiency of energy conversion. The prime mover 130 efficiency can be further separated into the fan efficiency (efficiency converting electrical power into fan power) and the combustion system efficiency (conversion of fuel stored energy into heat energy). The prime mover delivers 138 a mixture of air and combustion gases and byproducts under pressure to the heat exchanger 104 at an exit pressure, $P_A$, from the furnace exhaust (point "A"). The hot gas mixture enters the heat exchanger 104 and traverses its structure comprising surfaces 146 that are simultaneously exposed to hot combustion gas on the interior surfaces of the heat exchanger 104 and production fluid on the outside surfaces of the heat exchanger. These heat transfer surfaces 146 enable the bulk heat flow 145 of heat energy from the hot gas mixture 138 entering the heat exchanger 104 to the production fluid flowing within the pressure vessel 110. The air combustion mixture, depleted of most of the heat energy, exits 142 the heat exchanger 104 and enters the exhaust flue (point "B") at a pressure, $P_B$, exceeding the ambient pressure, $P_{amb}$, just enough to drive the exhaust gases out through the flue. As a result, the heat exchanger 104 presents a pressure drop from the pressure at the furnace exit, $P_A$, to the pressure at the flue inlet, $P_B$, denoted as the "furnace-to-flue" pressure drop, $P_{furnace\text{-}to\text{-}flue}$.

Since the blower 132 is the sole apparatus responsible for generating positive flow pressure the combustion inlet air 150 as it enters the combustion system 134, it produces the driving forces responsible for the pressure and volumetric mass flow of hot gas 138 entering the heat exchanger 104, after the pressure drop incurred by the combustion system 134. Increasing the fan power produces higher combustion gas pressure entering the heat exchanger 138, permitting the use of heat exchanger designs and configurations requiring high furnace-to-flue pressure drops, $P_{furnace\text{-}to\text{-}flue}$ while still maintaining a sufficient residual pressure, $P_B$, at the exhaust entering the flue. Furthermore, an important system design parameter was the electrical power utilized by the prime mover, where the user requirements typically limit the acceptable current and voltage consumption during installed operation.

Fluid heating system design conventions have limited fan design options the produce relatively low fan pressures, characterized by low electrical efficiencies. Consequently, fluid heating systems in practice have been limited to the use of heat transfer assemblies with a pressure drop to about 3.5 kPa or less and use blowers that create fan pressure of typically 0.5 pounds per square inch (psi) or less, and in all cases strictly less than 0.7 psi, above ambient pressure. As a result, current industry products utilize small, low-pressure blower fans to drive the thermal transfer fluid through heat transfer assemblies characterized by low inlet-to-outlet pressure drops, and adjust the geometry of the heat exchanger, the Heating Surface area, and surface treatments to achieve a desired heat transfer rate.

Figure 1C:
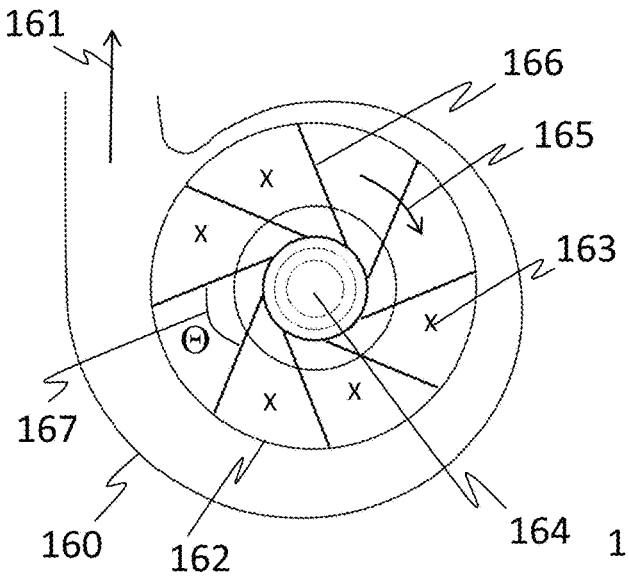
FIG. 1C shows a cross-sectional diagram of an embodiment of a fan using a straight blade impeller in accordance with embodiments of the present disclosure.

Recent advances in efficient electric motor technologies and sophisticated fan blade geometries have resulted in the advent of efficient high pressure fan options heretofore unavailable to the industrial and commercial fluid heating system designer. FIG. 1C shows an embodiment of a centrifugal fan design capable of high tip speed, high flow turning operation which—when used in conjunction with efficient electrical motor technologies—can produce fan designs capable of high-pressure, high volumetric flow rate, energy-efficient operation. The fan impellor comprises a collection of straight fan blades 166 disposed in a fan housing 160. As the impellor spins 165 on a bearing axis 164, ambient air flows 163 from outside of the housing into the collection of impellor spaces, and is discharged 161 though the fan exit port. The number, dimensions, spacing and separation angle 167 of the impellor blades determine the fan aerodynamic characteristics, while the fan motor design determines its electrical properties.

Figure 1D:
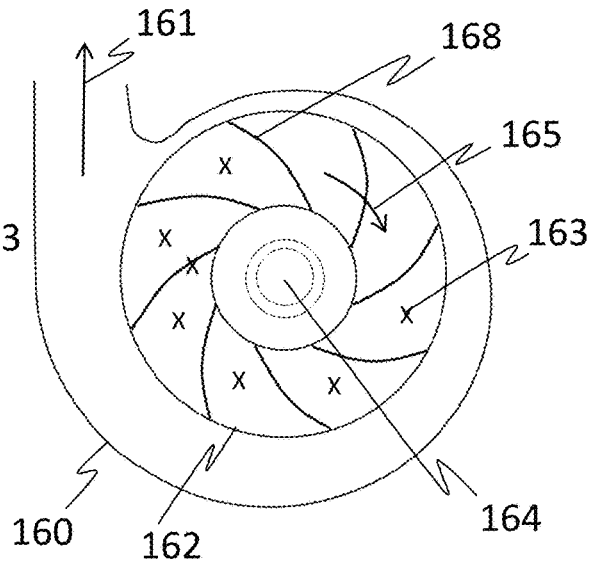
FIG. 1D shows a cross-sectional diagram of an embodiment of a fan using a wing blade impeller in accordance with embodiments of the present disclosure.

FIG. 1D shows another embodiment of a high-pressure, high-efficiency centrifugal fan using a curve or "wing" impellor blade geometry. The fan impellor comprises a collection of curved fan blades 168 disposed in a fan housing 160. As the impellor spins 165 on a bearing axis 164, ambient air flows 163 from outside of the housing into the collection of impellor spaces, and is discharged 161 though the fan exit port. The number, dimensions, spacing and separation angle, and wing curvature of the impellor blades determine the fan aerodynamic characteristics, while the fan motor design determines its electrical properties.

Figure 1E:
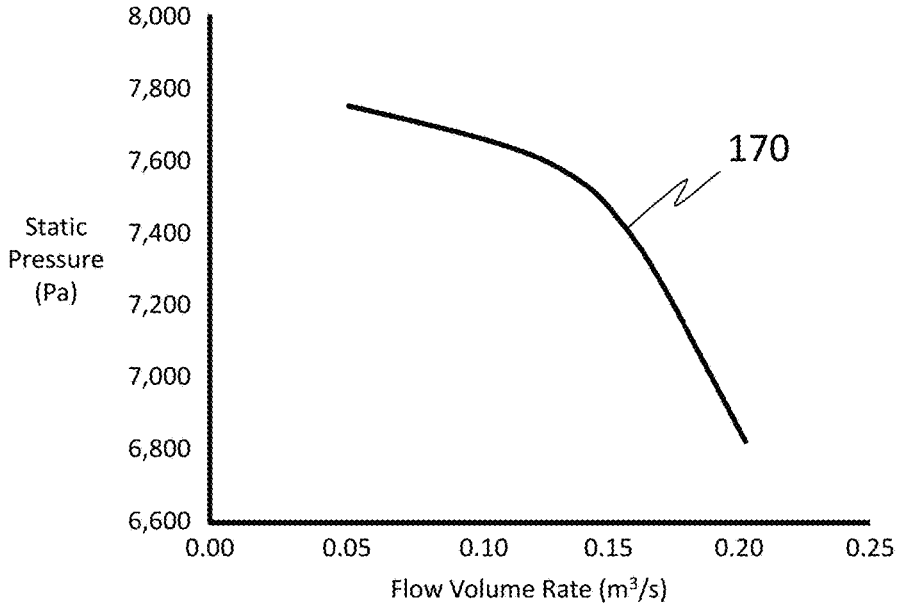
FIG. 1E shows a two-dimensional plot of static pressure as a function of flow rate volume for an embodiment of a fan using a wing blade impeller of the type shown in FIG. 1C in accordance with embodiments of the present disclosure.

FIG. 1E shows the functional characteristic performance curve 170 for the fan embodiment described in FIG. 1D as the static pressure produced by the fan operating at a tip rotational speed of 5371 RPM as a function of flow volume rate. In comparison, static pressures for conventional fan technologies would typically be in the range of 1,500 Pa to 2,500 Pa. The higher static pressures available from high-pressure, high-efficiency fan technologies results in a substantial expansion of heat exchanger configurations, since much higher pressure can be utilized to overcome higher furnace-to-flue pressure drops and increase gas flow velocities throughthe heat exchanger.

Figure 1F:
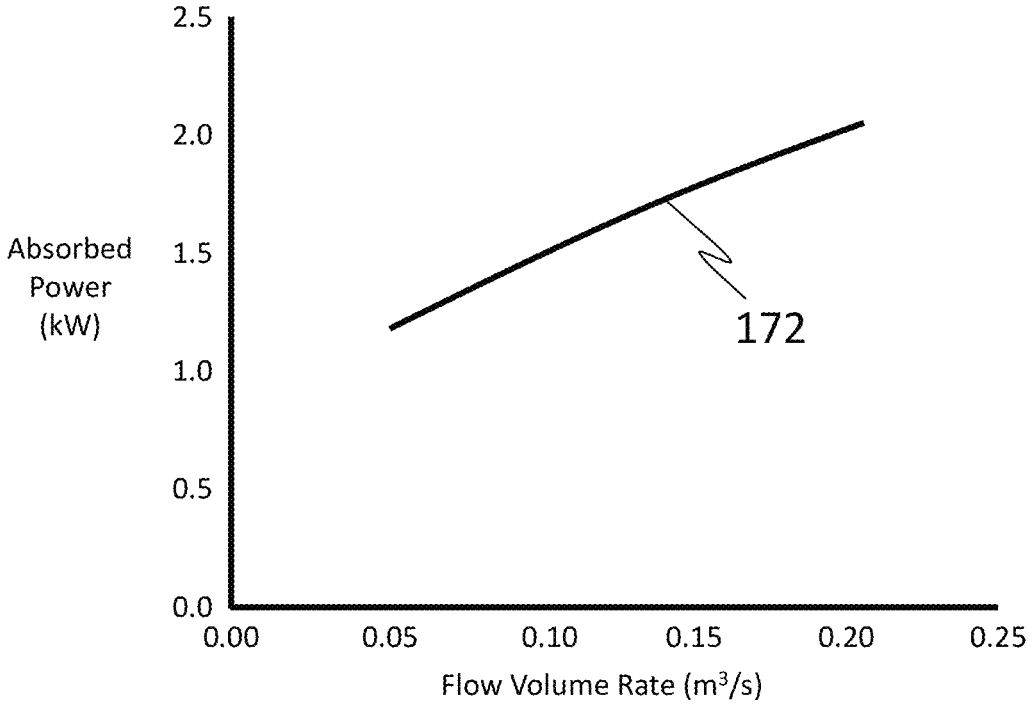
FIG. 1F shows a two-dimensional plot of absorbed power as a function of flow rate volume for an embodiment of a fan using a wing blade impeller of the type shown in FIG. 1C in accordance with embodiments of the present disclosure.

FIG. 1F shows the power consumption curve 172 for the fan embodiment described in FIG. 1D, described as the absorbed power by the fan operating at a tip rotational speed of 5371 RPM as a function of flow volume rate. Surprisingly, new motor technologies and sophisticated impellor geometries permit the high static pressures produced in FIG. 1E, but at nearly the same absorbed power requirements as exhibited by conventional technologies.

Figure 1G:
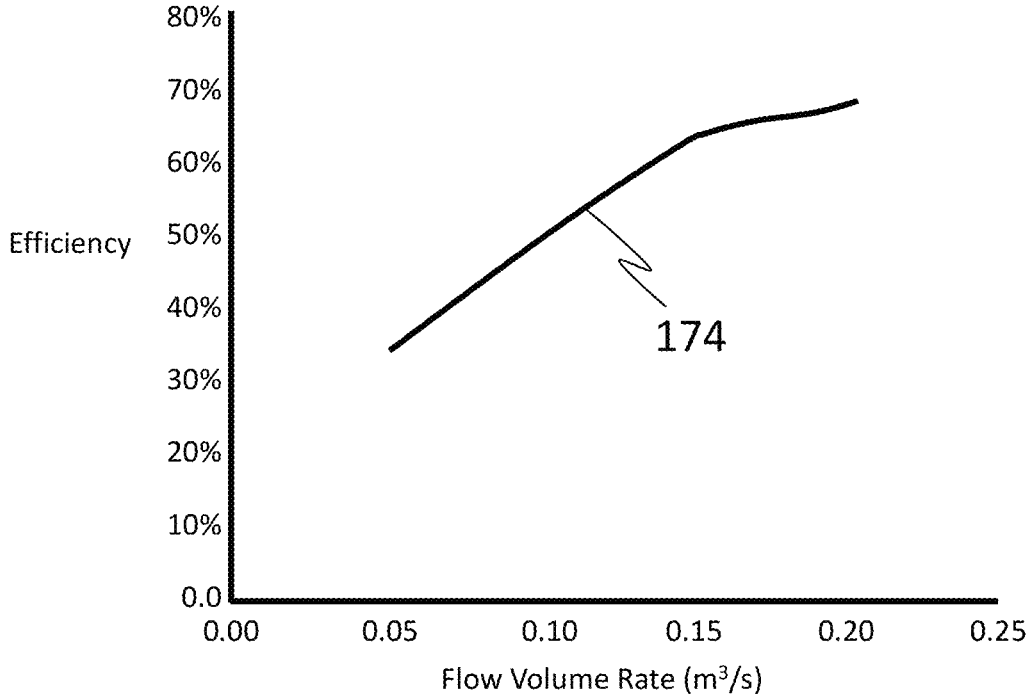
FIG. 1G shows a two-dimensional plot of efficiency as a function of flow rate volume for an embodiment of a fan using a wing blade impeller of the type shown in FIG. 1C in accordance with embodiments of the present disclosure.

FIG. 1G shows the efficiency curve 174 for the fan embodiment described in FIG. 1D, described as the energy conversion efficiency by the fan operating at a tip rotational speed of 5371 RPM as a function of flow volume rate. In comparison, efficiencies for conventional fan technologies would typically be 15% or more less than those displayed for this high-pressure, high-efficiency fan embodiment.

The increased heat transfer fluid velocity has at least two effects. The high velocity flow reduces the height of the turbulent boundary layer on the gas-side thermal transfer fluid flow and it increases the average overall turbulence of the flow (equivalently, the average Nusselt number of the flow through the thermal transfer apparatus). This discovery has been exploited by the inventors to produce a novel fluid heating system with a compact volume and footprint, improved thermal transfer efficiency, and reduced Heated Surface area with corresponding reductions in materials, cost, and manufacturing complexity.

Since the critical heat transfer property is the average improvement in the heat transfer coefficient, U, throughout the thermal transfer assembly (including the heat exchanger), the benefit of utilizing high pressure drop can be compared by using the Bulk Heat Flux, which can be computed by dividing the Gross Output by the total Heated Surface Area where the Gross Output is determined in accordance with Section 11.1.12 of the AHRI BTS-2000, the content of which is incorporated herein by reference in its entirety, and the total Heating Surface area is calculated by summing all of the heat transfer surfaces that are directly exposed to thermal transfer fluid.

In greater detail, the Bulk Heat Flux of a fluid heating system is a quantification of how much heat is passed through the walls of the heat exchanger, furnace, and any other heated parts, from the gas (thermal transfer fluid) side of the heater, to the water or steam (production fluid) side of the heater. The heat exchanger typically contributes between 65% and 100% of the total system bulk heat transfer from the thermal transfer fluid to the production fluid, with 85% to 90% being common.

Heaters with a high bulk heat flux, by nature, will be smaller than those with a lower bulk heat flux, assuming the same output heat is in the production fluid is desired, and that the architecture remains reasonably the same.

In this way, bulk heat flux can be said to indicate how effectively a design is using the material and surface area available for heat transfer.

Bulk Heat Flux in its simplest form can be defined as:

$$\text{Bulk Heat Flux}=q''=\text{Gross Output/Heated Surface Area}=q/A$$

where q" is the bulk heat flux (typically $W/m^2$ or $BTU/hr/ft^2$), Gross Output (also denoted $q_{production\ fluid}$, in units of W or BTU/Hr) is the amount of heat transferred per time into the production fluid through the wall, and A is the surface area in contact with the thermal transfer fluid, responsible for heat transfer to the production fluid.

Calculating the heat transfer surface area, A, is straight forward utilizing standard geometrical relationships.

The area of the external side of a cylinder is: $A=\pi D_{outside}L$, where $D_{outside}$ is the diameter of the exposed surface and L is the length of the cylinder;

The area of the internal side of a cylinder is: $A=\pi D_{inside}L$

Area of a fin would be: $A=2*h_{fin}*L_{fin}$, where $h_{fin}$ and $L_{fin}$ are the height and length of the fin, respectively;

and so on for all other geometries of the component heat transfer surface elements.

The heat output of the heater is slightly less straight forward, and measurement of such can be accomplished in a few different ways, depending both on method desired, and the type of production fluid being heated.

One method, referred to as "Combustion Efficiency" is a calculation method based on losses. The general equation can be represented as:

$$q_{out}=q_{in}-q_{stack\ loss}-q_{Skin\ Loss}$$

This is convenient, as $q_m$ is readily measured by metering the fuel input and multiplying it by the Calorific Value of the fuel (Heat/Quantity, either mass or volume pending the fuel). This is described in the AHRI BTS-2000 standard for efficiency testing, paragraph 11.1.3.

The stack loss, $q_{stack\ loss}$, can be calculated by measuring:

(1) temperature of air entering the heater;

(2) temperature of the flue gas leaving the heater;

(3) fraction of oxygen in the flue gas leaving the heater;

(4) relative humidity of the air entering the boiler; and (5) the fuel characteristics.

These quantities can be converted into the corresponding stack loss by the equations presented in AHRI BTS-2000, Paragraph 11.1.6. This method is widely accepted in the industry by those skilled in the art.

The total skin loss can be estimated by measuring the temperature of the jackets or surface of the heating unit, and calculating a free convection thermal loss of the unit, using commonly available correlations (For example, see "Fundamentals of Heat and Mass Transfer", by Bergman, et. al., $7^{th}$ Edition, Wiley Publishing, 2001, Chapter 9.)

A more direct method is to calculate thermal efficiency or thermal output directly. This method used commonly understood heat and mass transfer equations known to those skilled in the art, but differs slightly for each production fluid choice.

In the case where all heat transfer is done by sensible heat (that is, simply raising a fluid temperature without phase change, as in hydronic boilers and thermal fluid heaters) the calculation of heat output rate simply follows:

$$q_{output}=\dot{m}*c_p*(T_{in}-T_{out})$$

This can be seen in the AHRI BTS-2000 test standard as Paragraph 11.1.11.3, where $\dot{m}$ ("mdot", the flow mass rate of change) is replaced by by $W/t_T$ For steam boilers the procedure is slightly different, as both the sensible heat and the latent heat associated with vaporizing the liquid must be accounted for, and additionally, any liquid water that exits the boiler must also be accounted for, as it did not vaporize.

Minimally, the following parameters must be measured:

(1) mdot (mass/time) water fed into the boiler;

(2) mdot of liquid water exiting the boiler;

(3) pressure of the steam in the boiler, where standard steam property tables are used to determine the temperature of the steam at the given saturated pressure.

This set of values allows the calculation of thermal output directly, utilizing the AHRI BTS-2000 test standard in Paragraph 11.1.11.2.

The rest of the AHRI BTS-2000 standard describes the methods of measurement needed, apparatus setup, and standard conditions at which the thermal output is measured. For hydronic Boilers, this requires a determination of the production fluid flow rate that generates a 100° F. change in temperature across the heater, with the inlet condition held at 80° F. For Steam boilers, this is holding the boiler at 2 psig or less steam pressure. In both cases, the maximum heat input the unit is rated for should be supplied, within approximately 2%.

Traditional boiler and heater design was centered around commonly available, inexpensive, and ultimately inefficient fan designs. Furthermore, most commonly available burners were typically offered in package format, with the fan already selected and integrated into the burner assembly.

Figure 1H:
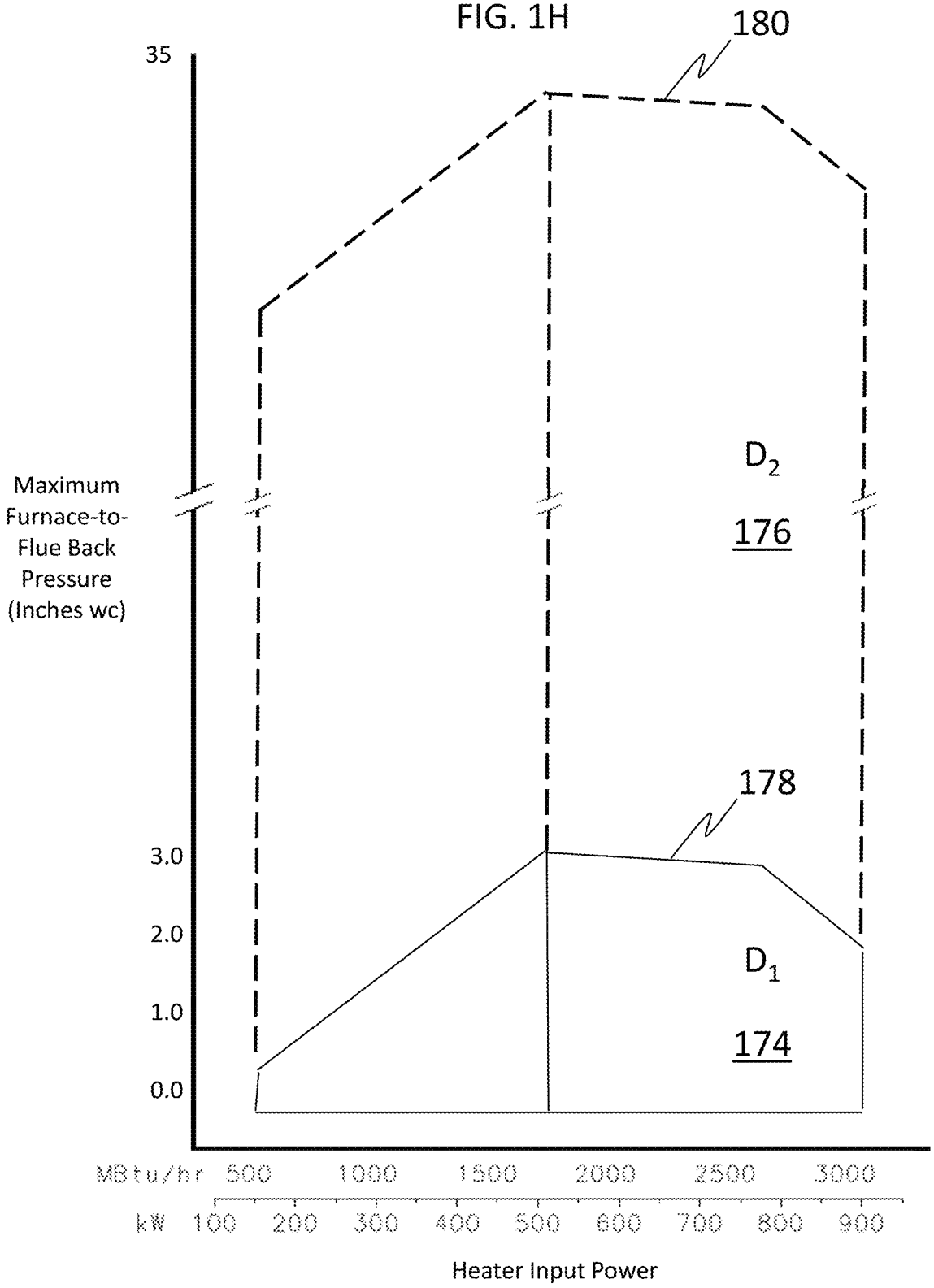
FIG. 1H displays a two-dimensional plot of combustion chamber pressure as a function of burner power output for a power burner illustrating the expansion of the design space achieved using high efficiency fans of the type shown in FIG. 1C in accordance with embodiments of the present disclosure.

This creates the scenario represented by $D_1$ in FIG. 1H. For a given fan, and with no ability to adjust the pressure drop over the combustion apparatus, the pressure available to the boiler/heater combination is limited to this space 174 denoted $D_1$.

This results in design philosophies which embrace low bulk heat flux and low back pressure solutions, so that commonly available parts are able to be used, and results in a relatively large heat exchanger with which to provide the output power to the customer.

This ultimately resulted in a design culture which held as a constant that boiler blowers are low pressure, high flow blowers, which perform very inefficiently against any degree of back pressure. The state of the art during this period also had limited efficiency motors available, and limited or no ability to change the operating speed of the blower or prime mover.

Breaking these blower constraints, and embracing modern, highly efficient, high pressure fan designs allows a substantive change in the design space available to the typical boiler designer, as represented by the enlarged design space 176 denoted by $D_2$. While high pressure fans are typically large (due to the mechanics of compression, particularly as related to the tip speed of the wheel), when these highly efficient fans with high discharge pressure are combined with high efficiency motors, and the ability to manipulate the operating speed of the machine, the blower can be shrunk back near the same size as traditional fans, and the additional shaft power used to create high pressure air streams is not experienced by the user, as it is compensated for by the highly efficient motor.

In fact, by embracing variable speed operation, and mildly increase electrical requirements are only felt at peak output, where heaters are only rarely operated.

Furthermore, with the heat exchanger design space greatly broadened, the thermal efficiency of a given heater can be greatly increased, while simultaneously shrinking the geometry, resulting in a heater which does not consume any more power (on a holistic, total basis) than their inefficient, and large footprint predecessors.

These great increases in efficiency and compactness are enabled by carefully optimizing the design pressure used by the product, and carefully engineering the heat exchanger flow path to provide the user with an optimum in energy usage, output power, and space constraints.

For fluid heating systems described herein, the thermal resistance on the production fluid (equivalently, "waterside" in the case of a hydronic or steam fluid heating system) side of a heat transfer surface is several orders of magnitudes smaller than on the thermal transfer fluid side (equivalently, "fireside" where the thermal transfer fluid is a heated gaseous mixture). Therefore, boiler designs that augment heat transfer surface area (e.g., addition of thermal fins) do so on the thermal transfer fluid side since adding surface area to the production fluid side is ineffective. When augmented surface areas are not incorporated into the design, increasing heat transfer surface area means enlarging the total surface area exposed on both sides to fluid, adding heat transfer surfaces thermal fluid and production sides equally. Therefore, in this disclosure heat flux determination as defined and computed is described on the thermal transfer fluid side of the exchange surfaces.

In an embodiment, the Bulk Heat Flux across the heat transfer assembly can be 30 kilowatt-hours per hour per square meter ($kW/m^2$) to 500 $kW/m^2$, or 30 $kW/m^2$ to 300 $kW/m^2$, or 32 $kW/m^2$ to 450 $kW/m^2$, or 34 $kW/m^2$ to 450 $kW/m^2$, or 36 $kW/m^2$ to 450 $kW/m^2$, or 38 $kW/m^2$ to 450 $kW/m^2$, or 40 $kW/m^2$ to 400 $kW/m^2$, or42 $kW/m^2$ to 400 $kW/m^2$, or 45 $kW/m^2$ to 400 $kW/m^2$, or 45 $kW/m^2$ to 400 $kW/m^2$, or 45 $kW/m^2$ to 400 $kW/m^2$, or 45 $kW/m^2$ to 300 $kW/m^2$, or 45 $kW/m^2$ to 300 $kW/m^2$, or 45 $kW/m^2$ to 300 $kW/m^2$, or 45 $kW/m^2$ to 450 $kW/m^2$, or 45 $kW/m^2$ to 400 $kW/m^2$, or 45 $kW/m^2$ to 350 $kW/m^2$, or 45 $kW/m^2$ to 300 $kW/m^2$, or 45 $kW/m^2$ to 250 $kW/m^2$, or 45 $kW/m^2$ to 200 $kW/m^2$, or 45 $kW/m^2$ to 150 $kW/m^2$, or 45 $kW/m^2$ to 125 $kW/m^2$, or 45 $kW/m^2$ to 120 $kW/m^2$, for example. In an embodiment, the Bulk Heat Flux is 45 $kW/m^2$ to 300 $kW/m^2$. In an embodiment, the Bulk Heat Flux across the heat transfer assembly is 45 $kW/m^2$ to 120 $kW/m^2$. In an embodiment, the Bulk Heat Flux across the heat transfer assembly is 45 $kW/m^2$ to 100 $kW/m^2$. In an embodiment, the Bulk Heat Flux across the heat transfer assembly is 47 $kW/m^2$ to 100 $kW/m^2$. In an embodiment, the Bulk Heat Flux across the heat transfer assembly is 47 $kW/m^2$ to 120 $kW/m^2$. The upper limit of the Bulk Heat Flux across the heat transfer assembly can be 1,000 $kW/m^2$, 800 $kW/m^2$, 600 $kW/m^2$, 500 $kW/m^2$, 400 $kW/m^2$, 450 $kW/m^2$, 350 $kW/m^2$, 300 $kW/m^2$, 250 $kW/m^2$, 200 $kW/m^2$, 150 $kW/m^2$, 125 $kW/m^2$, 120 $kW/m^2$, or 100 $kW/m^2$, for example, and is determined by the upper limit of what the material can transfer without impacting durability, limit of boiling curve to avoid film boiling, and limits on the total Q (heat transfer) imposed by the production fluid. The lower limit of the Bulk Heat Flux across the heat transfer assembly can be 30 $kW/m^2$, 35 $kW/m^2$, 40 $kW/m^2$, 45 $kW/m^2$, for example The upper and lower limits provided can be independently combined An aspect of the disclosed systems and methods is that utilizing a high pressure heat transfer assembly can be used with a high pressure blower to provide a compact, efficient, and practical fluid heating systems characterized by enhanced thermal heat transfer from a heated thermal transfer fluid to a production fluid. This discovery by the inventors applies to any configuration of fluid heating system where heat transfer is accomplished using Heating Surfaces exposed to a turbulent thermal transfer fluid flow, including (but not limited to) firetube and watertube hydronic, steam, and thermal fluid boilers. For simplicity, aspects of the disclosed system and methods are described where the gas path travels through a cavity in the production fluid (for example, in a firetube boiler). However, the disclosed system and methods can applied to other applications by a person of ordinary skill in the art and the disclosed system and methods are not limited to particular a configuration, such as a shell-and-tube or tubeless heat exchanger.

FIG. 1A also shows the location of the pressure measurements used to characterize the pressure drop across the heat transfer assembly. For the purposes of this disclosure, Pressure Drop refers to a change in pressure determined from the first point 116 (point "A") where a Heating Surface can contribute to the transfer of conductive heat energy from the thermal transfer fluid to the production fluid, to the last point 118 (point "B") in the flow satisfying that condition, also described as the pressure drop between the first end of the first conduit and the first end of the second conduit. That is, the Pressure Drop is the change in pressure measured across those heat transfer apparatus components that contribute to the Bulk Heat Flux. The points "A" and "B" were bound the fluid path where heat transfer from the thermal transfer fluid to the production fluid takes place. Point A corresponds to the point in the flow after any intake details, filter, or burner pressure losses, as all of these choices do not impact the thermal performance of the boiler system. Point B corresponds to the point where the system pressure is measured immediately after heat transfer stops taking place, and allows us to negate all installation details, such as flue length and diameter or the presence of inducer fans, or other installation details which introduce pressure drops. Together, measurements between these two points give us details independent of burner choice and installation effects.

In an embodiment, the Pressure Drop across the heat transfer assembly can be 2.5 kiloPascals (kPa) to 50 kPa, or 2.5 kPa to 45 kPa, or 3.0 kPa to 40 kPa, or 3.5 kPa to 40 KPA, or 4.0 kPa to 30 kPa, or 4.5 kPa to 30 kPa, or 5.0 kPa to 30 kPa, or 5.5 kPa to 20 kPa, or 6 kPa to 20 kPa, or 6.5 kPa to 20 kPa, or 7 kPa to 50 kPa, or 7.5 kPa to 50 kPa, or 8 kPa to 50 kPa, or 8.5 kPa to 50 kPa, or 9 kPa to 50 kPa, for example, wherein the foregoing upper and lower bounds can be independently combined. The lower limit of the Pressure Drop across the heat transfer assembly can be 2.5 kPa, 2.6 kPa, 2.7 kPa, 3.0 kPa, 3.2 kPa, 3.5 kPa, 3.7 kPa, 4.0 kPa, for example The upper limit of the Pressure Drop across the heat transfer assembly can be 50 kPa, 45 kPa, 40 kPa, 35 kPa, 30 kPa, 25 kPa, 20 kPa 15 kPa, 12 kPa, 10 kPa, for example In an embodiment, the Pressure Drop between the measurement point 116 of the conduit 102 and the measurement point 118 of conduit 106 in FIG. 1 is 3 kPa to 30 kPa. In an embodiment, the Pressure Drop between the measurement point 116 of the conduit 102 and the measurement point 118 of conduit 106 in FIG. 1 is 3 kPa to 10 kPa. In an embodiment, the Pressure Drop between the measurement point 116 of the conduit 102 and the measurement point 118 of conduit 106 in FIG. 1 is 3 kPa to 12 kPa.

Figure 2:
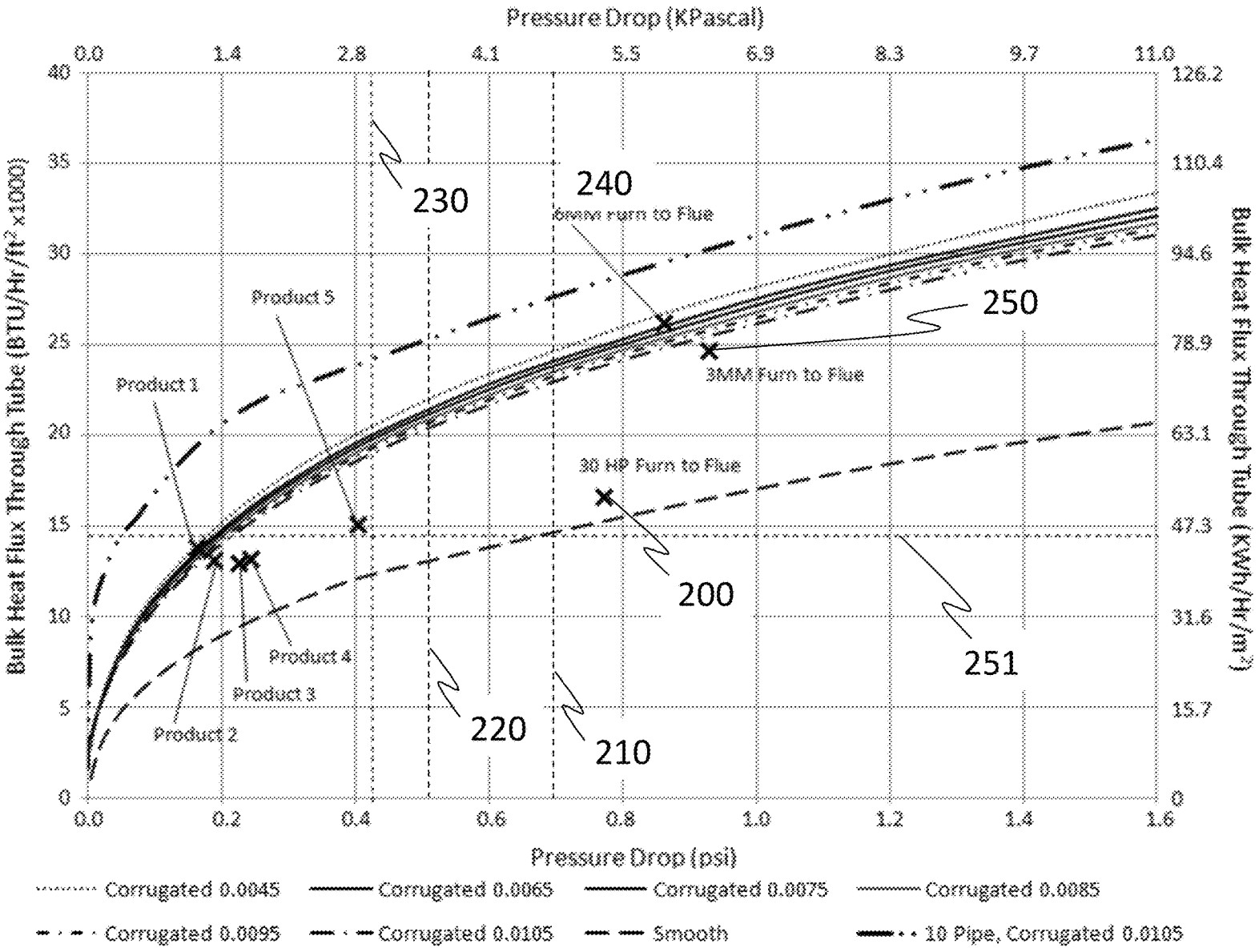
FIG. 2 is a graph of through tube bulk heat flux (British thermal units per hour per square foot, BTU/Hr/ft$^2$) and (kilowatt-hours per hour per square meter, KWh/Hr/m$^2$) versus pressure drop (pounds per square inch, psi) showing the results of a computer simulation showing the functional relationship between fluid heat system bulk heat flux as a function of pressure drop across the combined heat transfer surfaces. Overlaid on the graph are results for high pressure systems as described herein, and comparative results for products currently available from existing suppliers in accordance with embodiments of the present disclosure.

FIG. 2 shows results for the Bulk Heat Flux as a function of Pressure Drop using a computational simulation that has been extensively verified by experiment. Curves are shown illustrating the increase in Bulk Heat Flux as the Pressure Drop across the thermal transfer apparatus is increased for various types of Heating Surface corrugated treatments. Experimental results for three fluid heating systems are shown corresponding to a 3,000,000 BTU/hr ("3 MM Furn to Flue") 250, a 6,000,000 BTU/hr ("6 MM Furn to Flue")

240 hydronic boiler test boiler and a 30 HP tubeless steam boiler ("30 HP Furn to Flue") 200 steam boiler using high Pressure Drop thermal transfer apparatus and high pressure blowers, as described herein. Also plotted are values corresponding to five actual steam and hydronic boiler products currently available from current market suppliers utilizing low Pressure Drop heat transfer apparatus and low pressure blowers. (Product 1=3 Million BTU/hr Hydronic FHS; Product 2=2 Million BTU/hr Hydronic FHS; Product 3=2.61-2.88 Million BTU/hr Hydronic FHS; Product 4=4 Million BTU/hr Hydronic FHS; Product 5=6 Million BTU/hr Hydronic FHS.) It is seen that current products operate at much lower furnace-to-flue Pressure Drop values than the example systems described herein, and the current products produce a lower Bulk Heat Flux through the tube than the example systems described herein. In fact, because of the limitations imposed by conventional fan technologies, currently available examples of fluid heating systems limit the heat transfer assembly pressure drop to about 3.5 kPa or less and use blowers that create fan pressure of typically 0.5 pounds per square inch (psi) or less, and in all cases strictly less than 0.7 psi, above ambient as shown by lines 220, 210, respectively. The inventors have surprisingly discovered that operation above 3.5 kPa is feasible, and when proper system design methods are employed to manage the thermal environments at high bulk heat flux regions, fluid heating systems utilizing furnace-to-flue pressure drops at or above 3 kPA 230 are possible operating at bulk heat flux values above 14,700 BTU/hr/ft$^2$ shown by line 251. Indeed, operation at 0.5 psi 220, typically the design limit of current systems, is possible with bulk heat flux values above 14,700 BTU/hr/ft$^2$. Moreover, the inventors have demonstrated operation above 0.7 psi 210, the limit of all current systems known to the inventors, with bulk heat flux values above 14,700 BTU/hr/ft$^2$. As a result, the inventors have surprisingly demonstrated operational systems incorporating high pressure-to-flue pressure drop heat exchanger apparatus above 3 kPA and 0.5 psi and 0.7 psi, resulting in bulk heat flux values over 14,700 BTU/hr/ft$^2$ line 251 but maintaining energy efficiencies typical of current conventional fluid heating systems.

Figure 3:
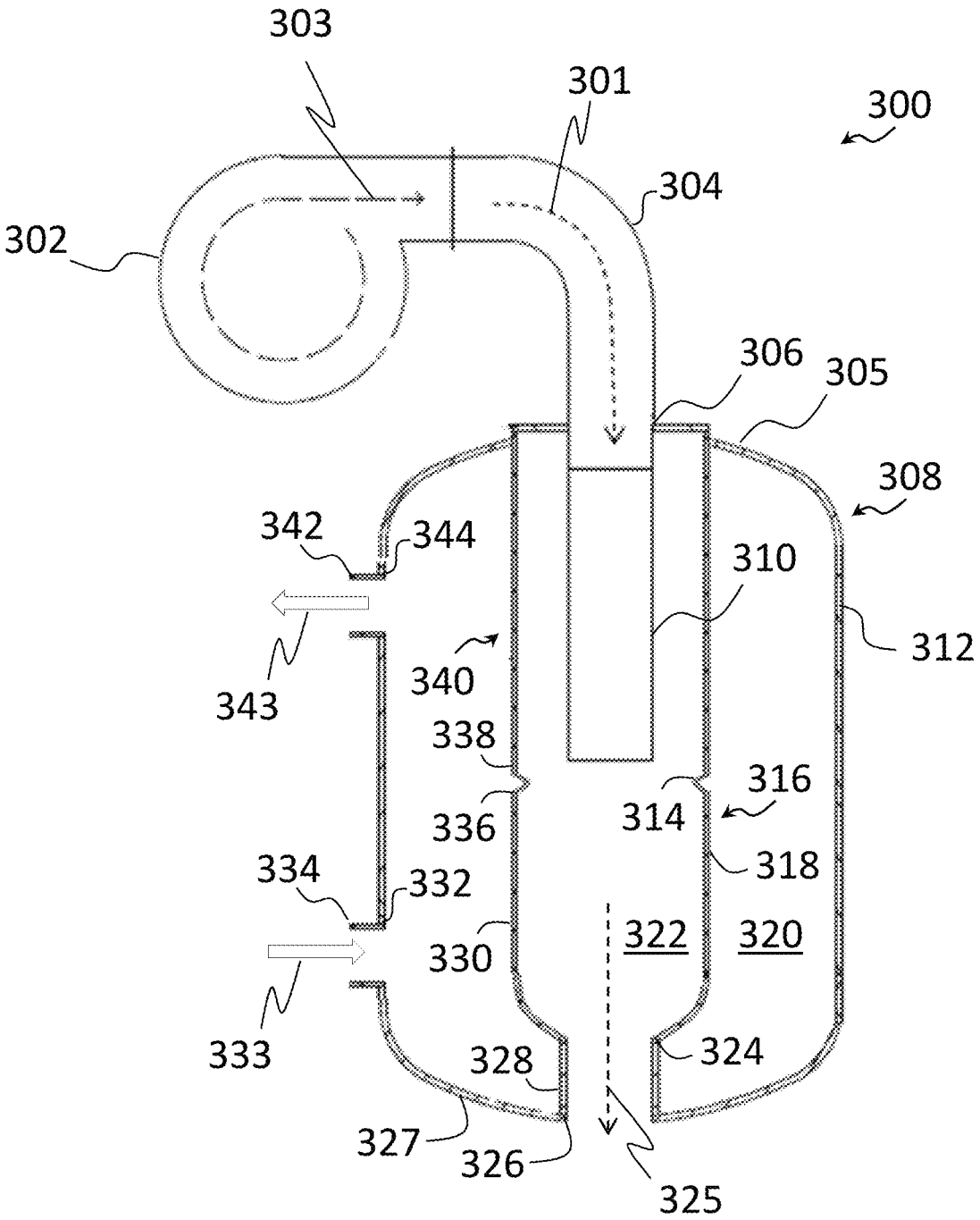
FIG. 3 is a cross-sectional diagram of a fluid heating system including a heat exchanger in accordance with embodiments of the present disclosure.

Shown in FIG. 3 is a type of fluid heating system 300 in which the thermal transfer fluid can be a hot combustion gas. As shown in FIG. 3, the blower 302 forces air through a conduit 304 and into a burner 310 where the fuel-air mix is ignited and burns within the furnace 340 through a top head 306. Production fluid is forced into the pressure vessel 308 under pressure through a conduit 334 into the pressure vessel inlet 332 where it flows through the space surrounding the heat exchanger and exits the pressure vessel outlet 342 that penetrates the pressure vessel 344. The pressure vessel comprises a top head 305, a pressure vessel shell 312, and a bottom head 327. The hot combustion gas exits the furnace through a seal or conduit 314 disposed between the outlet 338 of the furnace and the inlet 336 of the heat exchanger 316 where the thermal energy is conveyed from the combustion gas flowing through the heat exchanger cavity 322 to the production fluid 320 flowing through the pressure vessel across the Heating Surface 318. The combustion gas may be directed through shaped sections 330 to exit the heat exchanger outlet 324 that penetrates 326 the pressure vessel where it is directed through a conduit 328 outside the pressure vessel.

Figure 4:
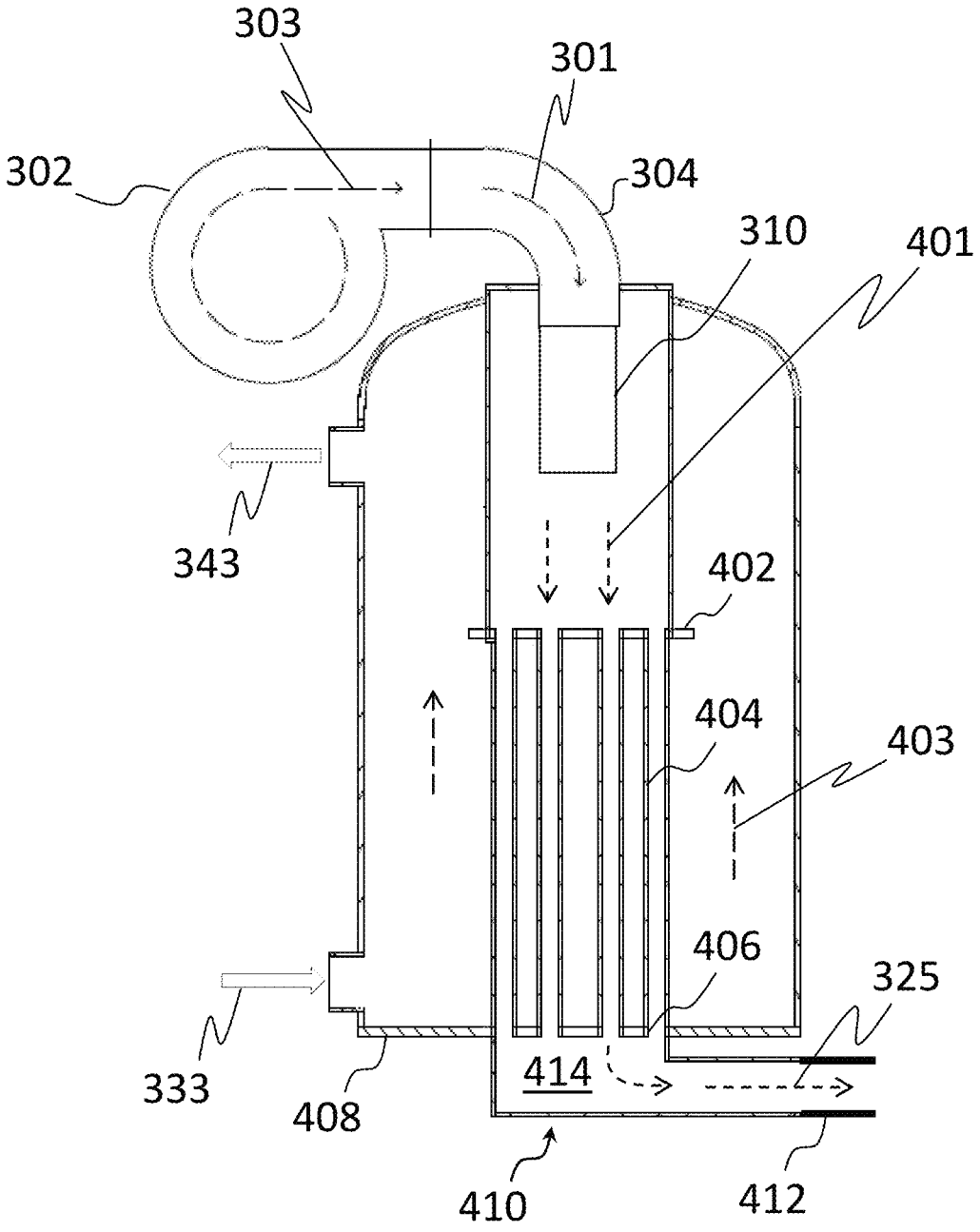
FIG. 4. is a cross-sectional diagram of a fluid heating system including a shell-and-tube heat exchanger in accordance with embodiments of the present disclosure.

Heat exchanger designs vary, and a person of ordinary skill in the art can adapt the disclosed systems and methods to specific heat exchanger configurations without undue experimentation. In an embodiment, a shell-and-tube heat exchanger is incorporated, where the primary element of the Heating Surface comprises a collection of thin-wall tubes that convey the heated thermal transfer fluid from the furnace to the exhaust conduit. FIG. 4 shows an embodiment of a fluid heating system incorporating a shell-and-tube heat exchanger comprising a collection of tubes 404 disposed between upper 402 and lower 406 tubesheet, which may form part of the pressure vessel 408. The heat is transferred from the thermal transfer fluid to the production fluid across the wall surfaces of numerous thin-walled fluid conduits, e.g., tubes having a wall thickness of less than 0.5 centimeters (cm). FIG. 4 also illustrates that the exhaust combustion gases exiting the heat exchanger tubes can be collected in the collection space 414 within the exhaust manifold 410 to be directed away from the fluid heating system to the flue 412. In this embodiment shown the tubesheet is also the bottom head of the pressure vessel, so the exhaust manifold cavity lies outside the pressure vessel.

Tubeless heat exchangers are also used. Tubeless heat exchangers avoid the use of the thin-walled tubes and the tubesheets associated with tube-and shell heat exchangers. In an embodiment, a tubeless heat exchanger comprises at least two flow cavities, a heat exchanger core section designed to convey a thermal transfer fluid from an inlet port to an exhaust port, and a pressure vessel designed to convey a production fluid from a separate inlet port to a separate outlet port. The heat exchanger core can be partly or entirely contained within the pressure vessel and the thermal transfer fluid flow through the heat exchanger can be contained within the core section. The pressure vessel comprises an external shell, all external surfaces of the heat exchanger core, the outer surfaces of the core inlet and exhaust ports, and other fluid heating system components. The flow of production fluid through the heat exchanger is contained entirely within the pressure vessel.

Figure 5:
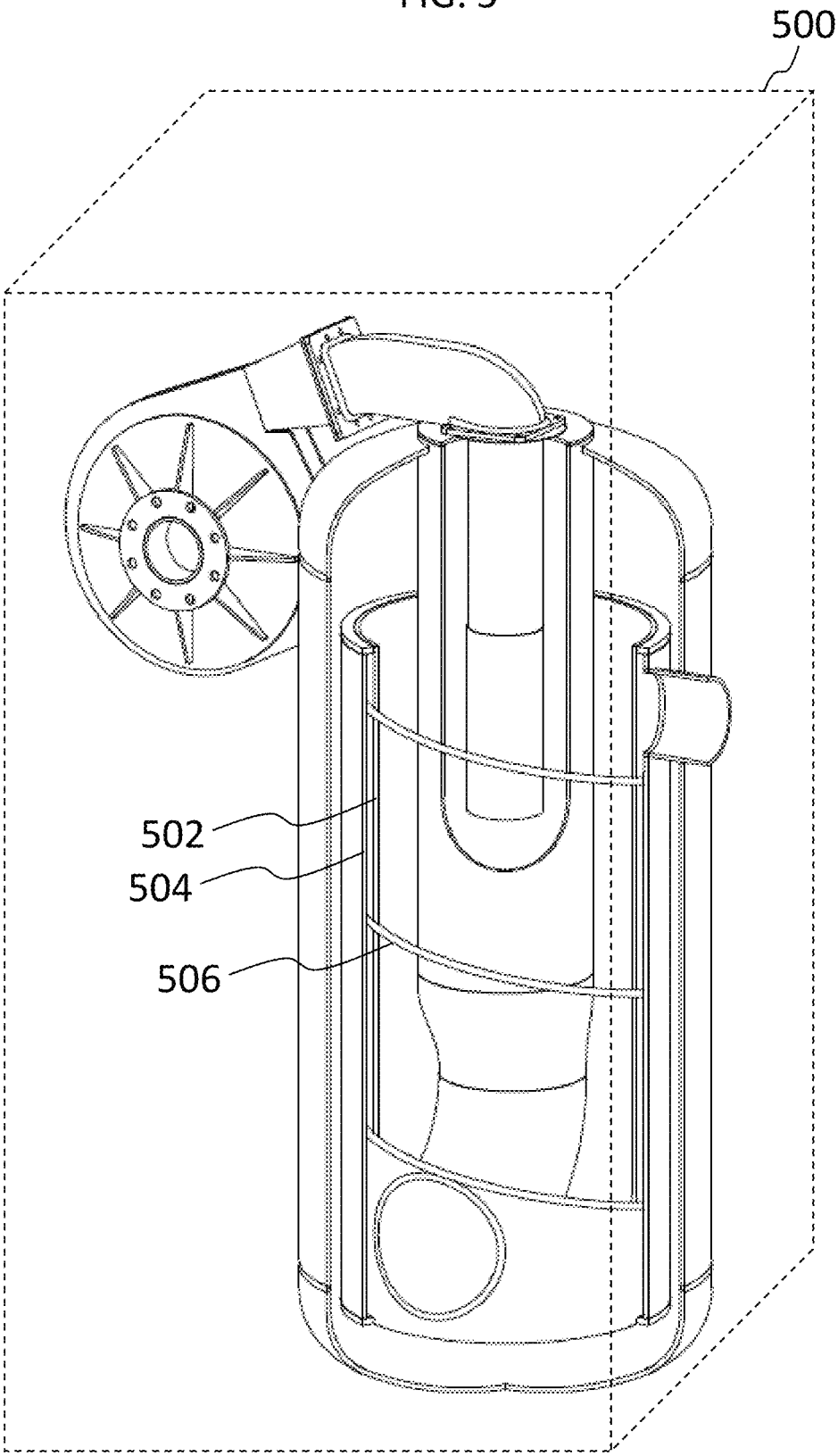
FIG. 5 is a perspective view of an embodiment of a fluid heating system incorporating a tubeless heat exchanger in accordance with embodiments of the present disclosure.

If desired, the tubeless heat exchanger core can further comprise a flow element, e.g., a rib or a ridge, to direct the flow of the thermal transfer fluid, e.g., to provide a longer path between the inlet and the outlet of the tubeless heat exchanger core. As shown in FIG. 5, a rib 506 can be a distinct element that can be disposed between the inner casing 502 and the outer casing 504 of the exchanger core to direct the flow of the thermal transfer fluid between the inlet and the outlet of the heat exchanger core. This configuration acts to reduce the heat convected to the fluid heating system body shell 500. The rib can be welded, for example. In an embodiment, an average aspect ratio of the flow passage between the inner casing and the outer casing is between 3, 5, 10, 100, 200 or 500, preferably 10 to 100, wherein the aspect ratio is the ratio of a height of the flow passage created between the inner casing, the outer casing and the rib to a width of the flow passage, wherein the height is a distance between opposite surfaces of neighboring flow elements and is measured normal to a surface of a first flow element and wherein the width of the flow passage is measured from an outer surface of the inner casing to an inner surface of the outer casing, wherein the inner surface of the inner casing and the outer casing are each interior to the flow passage.

Details for the design, use and manufacture of ribbed and ridged tubeless heat exchangers and fluid heating systems incorporating ribbed and ridged tubeless heat exchangers are provided in U.S. Provisional Patent application Ser. No. 62/124,502, filed on Dec. 22, 2014; U.S. provisional patent application Ser. No. 62/124,235, filed on Dec. 11, 2014; U.S. Non-Provisional patent application Ser. No. 14949948, filed on Nov. 24, 2015; U.S. Non-Provisional patent application Ser. No. 14949968, filed on Nov. 24, 2015; and U.S. Non-Provisional patent application Ser. No. 24172713, filed on Nov. 24, 2015, the contents of which are included herein by reference in their entirety.

Alternatively, a deformation in the inner casing, the outer casing, or combination thereof can be used to provide the flow element. In an embodiment, the tubeless heat exchanger core comprises a top head, a bottom head, an inner casing disposed between the top head and the bottom head, an outer casing disposed between the top head and the bottom head and opposite an inner surface of the inner casing, wherein at least one of the inner casing and the outer casing comprises a ridge, wherein the inner casing and the outer casing define a flow passage between the second inlet and the second outlet of the tubeless heat exchanger core, wherein the second inlet of the tubeless heat exchanger core is disposed on the inner casing, the outer casing, or a combination thereof, and wherein the second outlet of the tubeless heat exchanger core is disposed on the inner casing, the outer casing, or a combination thereof. The ridge can be provided by stamping, or hydraulic or pneumatic deformation, for example.

The heat exchanger and boiler industries—and persons with ordinary skill in the art in these industries—distinguish tubes used for heat transfer surfaces in tube-and-shell heat exchangers from other conduits (e.g., flow passages in tubeless heat exchangers) using the following definitions: A tube is a hollow conduit with circular or elliptical cross-section whose dimension is specified by the outside diameter and wall thickness is usually provided in terms of the Birmingham Wire Gauge (BWG) or Stubbs' Wire Gauge convention ranging from 5/0 gauge (0.500 inch wall thickness) to 36 gauge (0.004 inch wall thickness). Other metal conduits for thermal transfer fluid—like pipes—use different specification conventions; for example, pipe is customarily identified by "Nominal Pipe Size" (NPS) whose diameters only roughly compare to either the actual inside or outside diameter and with wall thickness defined by "Schedule Number" (SCH).

However, this definition of "tube" obfuscates the functional properties that are useful in classifying and characterizing the distinctions between tube-and shell heat exchangers—as opposed to tubeless design alternatives—particularly in regards to the surprising, state-of-the-art advance represented by the present systems and methods. For the purposes of this disclosure, unless otherwise specified, definitions are provided based on the functional distinctions between tubes and more robust heat transfer components. A tube-and-shell heat exchanger is a design classification wherein the primary location of heat exchange occurs across the wall surfaces of a numerous plurality of thin-wall 0.5 centimeters (cm) wall thickness) metal or metal alloy fluid conduits—which may or may not have circular cross-section—called tubes, secured at either or both ends to a tubesheet, e.g., by welded portions, or weldments. Functional characteristics of a tube-and shell heat exchanger include the presence of a large number of weldments or other mechanical fastening means (mandrel expansion for instance) between the thin-wall conduits (tubes) and the tubesheets and the presence of a numerous plurality of thin-wall conduits, both of which are susceptible to cracking and other material failures induced by corrosion, mechanical movement and thermal stresses. Because they occur within the pressure vessel, tubes, tubesheets, and connection failures are difficult and expensive to service or replace, particularly in field installations.

Tubeless heat exchangers refer to heat exchanger designs that avoid the use of thin-wall metal or metal alloy fluid conduits and the resulting plethora of conduit weldments to tubesheets in favor of other—less fragile—alternatives as heat transfer surfaces. In particular, tubeless conduit-and-shell heat exchangers are characterized by the presence of few fluid conduits comprising components of thicker 0.5 cm) average minimum dimension and the absence of tubesheets with many conduit-to-tubesheet weldments. In practice, tubeless conduit-and-shell heat exchangers share some features with tube-and-shell designs including the structure and manufacture of the pressure vessel, methods of supplying hot thermal transfer fluid and cooler production fluid, and the design of regulatory control systems. However, the heat exchange core section of a tubeless conduit-and-shell heat exchanger substitutes a less fragile thermal transfer fluid conduit structure with fewer than half the distinct flow paths comprising robust metal and metal alloy components with the same or greater heat transfer capacity as compared to an equivalent tube and tubesheet structure.

Figure 6:
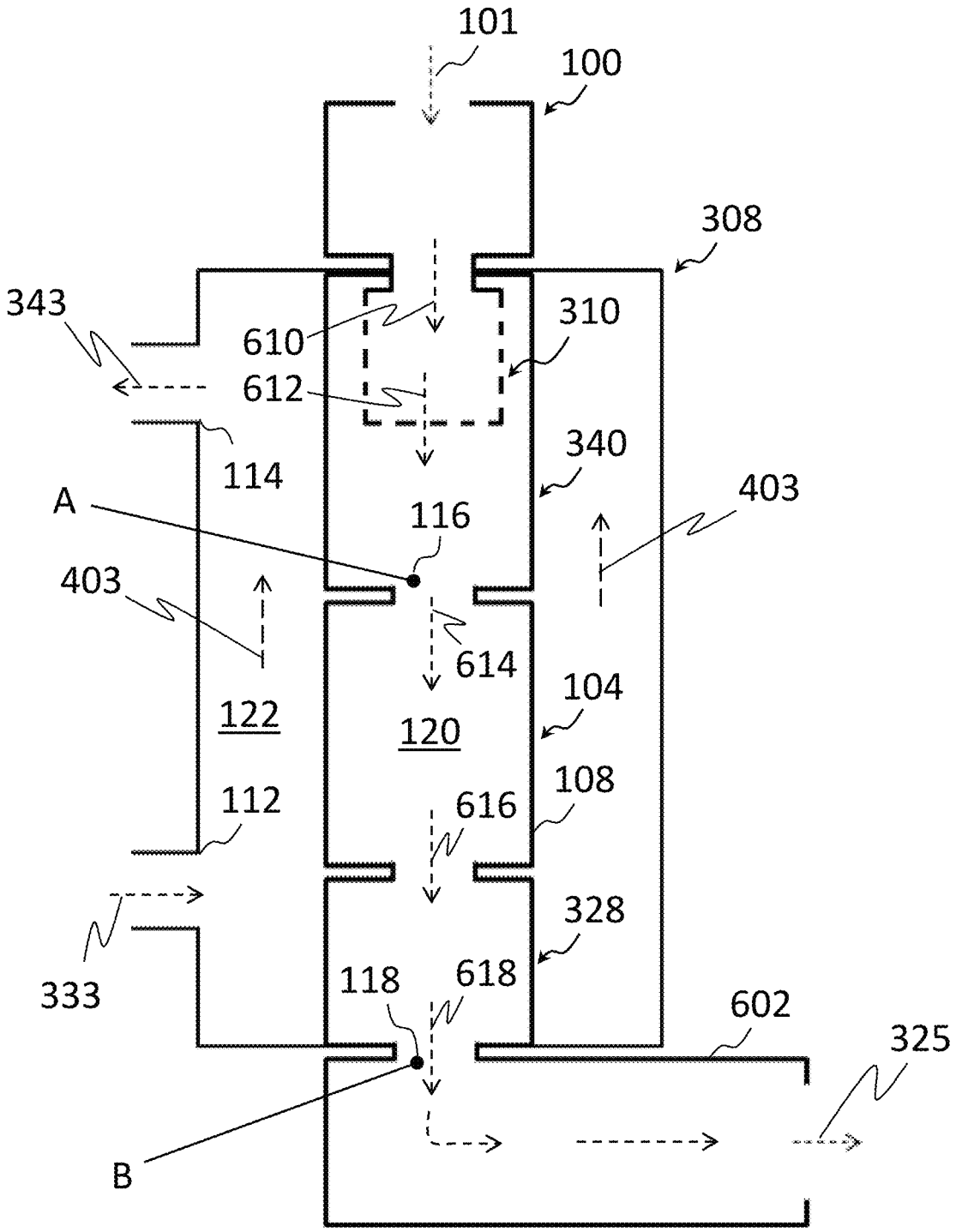
FIG. 6 is a functional diagram of an embodiment of a fluid heating system showing a burner, furnace, heat exchanger, and exhaust manifold and flue assembly illustrating the location of the Pressure Drop measurement points for this configuration in accordance with embodiments of the present disclosure.

Shown in FIG. 6 is a schematic of an embodiment of a fluid heating system in which a fuel-air mixture is forced under pressure by a blower 100 into a burner 310 where the mixture is ignited. The hot combustion gases flow under pressure from the furnace 340 into a heat exchanger 104 where the primary transfer of thermal energy from the flowing combustion gas 120 to the production fluid flowing in the space 122 bounded by the pressure vessel occurs across the Heating Surfaces 108 of the heat exchanger. In an embodiment, the furnace 340 is directly connected to the heat exchanger 104, and a means for pressurizing the combustion gases from the furnace and prior to their entry into the heat exchanger can be omitted. Exhaust gas from the heat exchanger is expelled through an exhaust manifold 328 and into the exhaust flue 602 where they are directed away from the fluid heating system. Production fluid is forced into the pressure vessel 308 through an inlet 112 where it flows through the space 122 surrounding the heat exchanger and exits through an outlet 114. For example, in a tube Hx the fluid flows around the tubes. For tubeless Hx . . . The Pressure Drop (or furnace-to-flue pressure drop) across the thermal transfer assembly is measured as the change in pressure from the furnace outlet 116 (point "A") to the inlet 118 of the flue 602 (point "B").

The heat exchanger core can have any suitable dimensions. Specifically provided is the case where inner casing and the outer casing each independently have a largest outer diameter of 15 centimeters (cm), 25 cm, 30 cm, 350 cm, 650 cm, or 1,400 cm. For example, the inner casing and the outer casing can each independently have a largest outer diameter of 15 cm to 1,400 cm. An embodiment in which the inner casing and the outer casing each independently have a largest outer diameter of 30 cm to 350 cm or 40 cm to 300 cm is preferred.

The inner casing and the outer casing can each independently have a maximum height of 15 centimeters (cm), 25 cm, 30 cm, 350 cm, 650 cm, or 1,400 cm. For example, the inner casing and the outer casing can each independently have a maximum height of 15 cm to 1,400 cm. An embodiment in which the inner casing and the outer casing each independently have a largest outer diameter of 30 cm to 650 cm or 40 cm to 500 cm is preferred.

The fluid heating system can be used to exchange heat between any suitable fluids, e.g., between a first fluid and the second fluid, wherein the first and second fluids can each independently comprise a gas, a liquid, or a combination thereof. In a preferred embodiment the first fluid, which is directed through the heat exchanger core, is a gaseous thermal transfer fluid, and can be a combustion gas, e.g., a gas produced by fuel fired combustor, and can comprise water, carbon monoxide, carbon dioxide, or combination thereof. Herein, reference to "high pressure" or "high pressure drop" refer to pressure measurements of the thermal transfer fluid; equivalently referred to as the fireside pressure in embodiments where the thermal transfer fluid is a gaseous heated gas or the result of a combustion process.

The second fluid, which is directed through the pressure vessel and contacts an entire outer surface of the heat exchanger core, is a production fluid and can comprise water, steam, oil, a thermal fluid (e.g., a thermal oil), or combination thereof. The thermal fluid can comprise water, a C2 to C30 glycol such as ethylene glycol, a unsubstituted or substituted C1 to C30 hydrocarbon such as mineral oil or a halogenated C1 to C30 hydrocarbon wherein the halogenated hydrocarbon can optionally be further substituted, a molten salt such as a molten salt comprising potassium nitrate, sodium nitrate, lithium nitrate, or a combination thereof, a silicone, or a combination thereof. In hydronic products, a glycol-water mixture with a glycol concentration between 10-60% by volume may be used. Representative halogenated hydrocarbons include 1,1,1,2-tetrafluoroethane, pentafluoroethane, difluoroethane, 1,3,3,3-tetrafluoropropene, and 2,3,3,3-tetrafluoropropene, e.g., chlorofluorocarbons (CFCs) such as a halogenated fluorocarbon (HFC), a halogenated chlorofluorocarbon (HCFC), a perfluorocarbon (PFC), or a combination thereof. The hydrocarbon can be a substituted or unsubstituted aliphatic hydrocarbon, a substituted or unsubstituted alicyclic hydrocarbon, or a combination thereof. Commercially available examples include THERMINOL VP-1, (Solutia Inc.), DIPHYL DT (Bayer A. G.), DOWTHERM A (Dow Chemical) and THERM 5300 (Nippon Steel). The thermal fluid can be formulated from an alkaline organic and inorganic compounds. Also, the thermal fluid can be used in a diluted form, for example with concentrations ranging from 3 weight percent to 10 weight percent. An embodiment in which the thermal transfer fluid is a combustion gas and comprises liquid water, steam, or a combination thereof and the production fluid comprises liquid water, steam, a thermal fluid, or a combination thereof is specifically mentioned.

Also disclosed is a method of heat transfer, the method comprising: providing a fluid heating system comprising a pressure vessel comprising a first inlet and first outlet, a heat exchanger core which can be entirely disposed in the pressure vessel; and disposing a gaseous or vapor thermal transfer fluid in the tubeless heat exchanger core and a production fluid in the pressure vessel to transfer heat from the thermal transfer fluid to the production fluid. The disposing of the thermal transfer fluid into the tubeless heat exchanger core can be conducted by directing a combustion gas into the heat exchanger core using a blower, for example. The method of heat transfer can comprise directing the thermal transfer fluid from the first inlet to the first outlet to provide a flow of the thermal transfer fluid through the pressure vessel, and directing the production fluid from the second inlet to the second outlet to provide a flow of the production fluid through a flow passage of the tubeless heat exchanger core. The directing can be provided using a pump, for example. The combination recited satisfies the condition that a Bulk Heat Flux between the first end of the first conduit and the first end of the second conduit is between 45 kW/m2 and 300 kW/m2 wherein Bulk Heat Flux is determined by dividing the Gross Output by the Total Heated Surface Area where the Gross Output is determined in accordance Section 11.1.12 of the AHRI BTS-2000, the content of which is incorporated herein by reference in its entirety, and the Total heated Surface Area is calculated by summing all of the heat transfer surfaces that are directly exposed to thermal transfer fluid, and wherein the Pressure Drop between the first end of the first conduit and the first end of the second conduit is between 2.5 kiloPascals (kPa) to 50 kPa, or 2.5 kPa, 3.0 kPa, 3.5 kPa, 4.0 kPa, 4.5 kPa, 5.0 kPa, 5.5 kPa, 6 kPa, 6.5 kPa, 7 kPa, 7.5 kPa, 8 kPa, 8.5 kPa or 9 kPa to 50 kPa, 40 kPa, 30 kPa, 20 kPa, 15 kPa or 12 kPa, wherein the foregoing upper and lower bounds can be independently combined. An embodiment in which the Pressure Prop between 3 kPa to 30 kPa is specifically provided.

Figure 7:
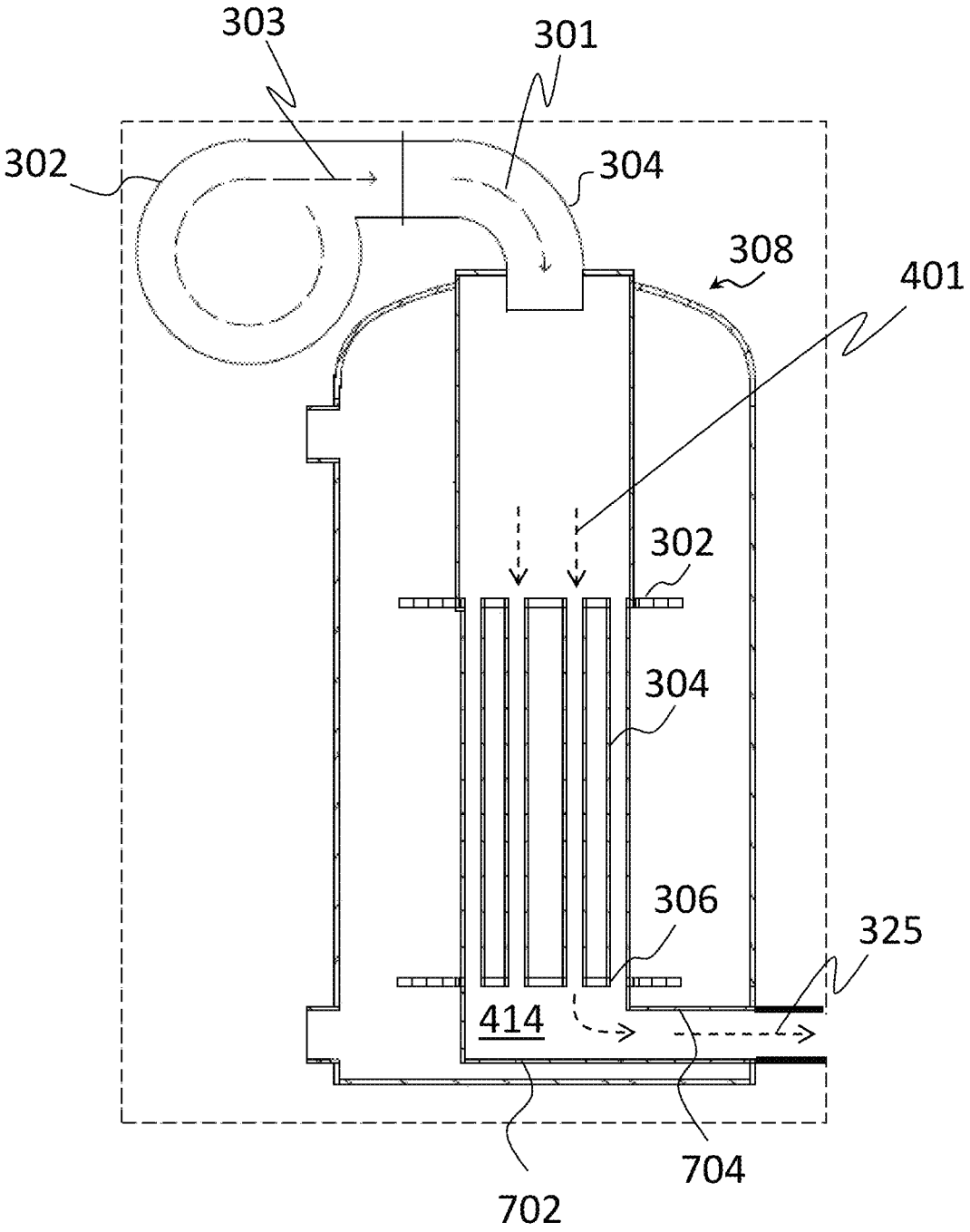
FIG. 7 is a cross-sectional diagram of an embodiment of a fluid heating system incorporating a shell-and-tube heat exchanger entirely contained within the pressure vessel in accordance with embodiments of the present disclosure.

In any of the foregoing embodiments, the pressure vessel can be configured to contain a production fluid such that an entirety of an outer surface of the heat exchanger core is contacted by the production fluid; and/or an entirety of a flow passage of the heat exchanger core can be disposed entirely in the pressure vessel. FIG. 7 shows an embodiment of a shell-and-tube heat exchanger comprising the upper tubesheet 302, the heat exchanger tubes 304 and the lower tubesheet 306 is entirely disposed in the pressure vessel 308. The exhaust gas exiting the lower tubesheet collects in the exhaust manifold 702, still within the pressure vessel, where it is directed through a conduit 704 to an exhaust flue.

Figure 8:
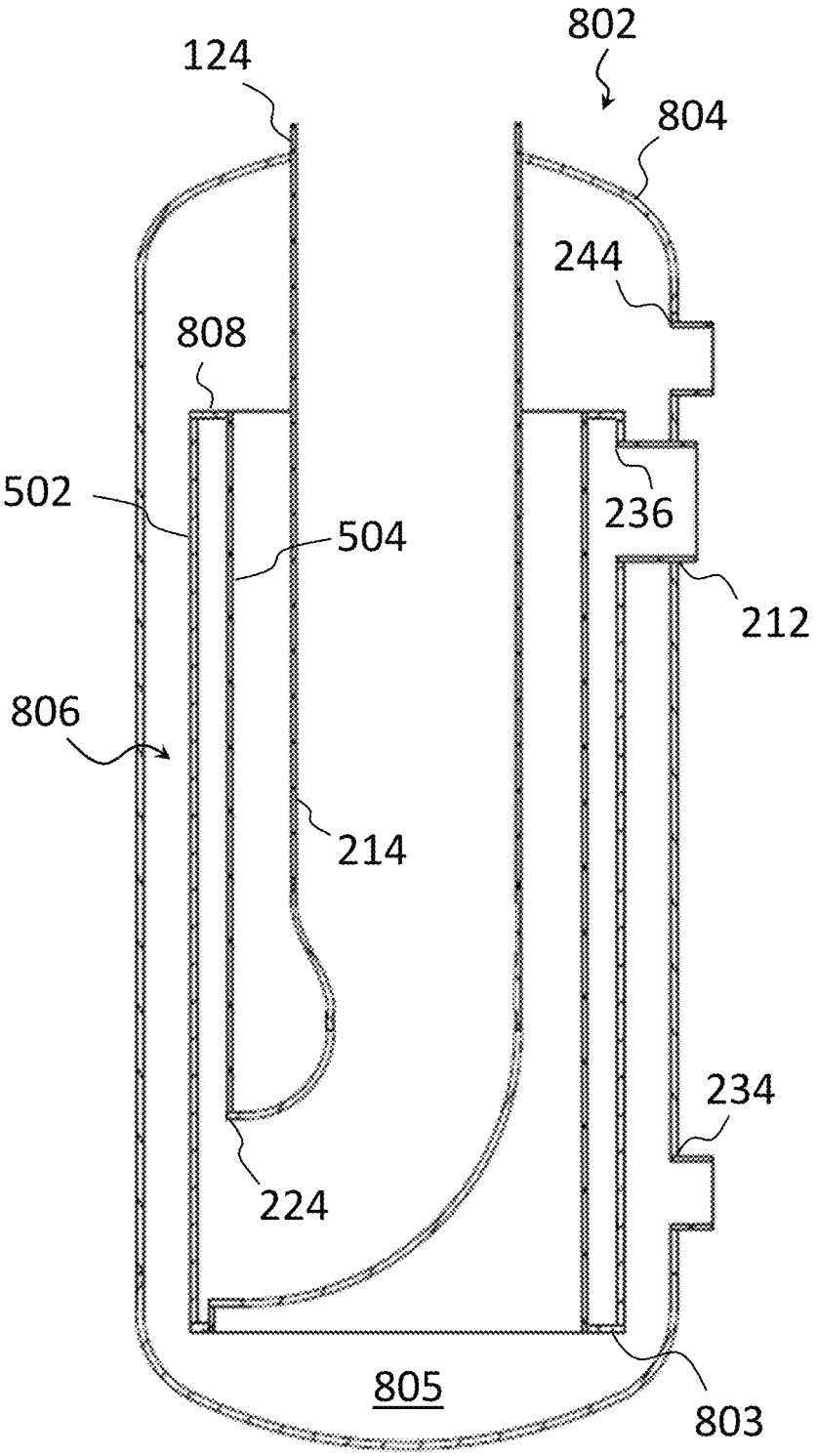
FIG. 8 is a perspective view of an embodiment of a fluid heating system incorporating a tubeless heat exchanger entirely contained within the pressure vessel in accordance with embodiments of the present disclosure.

FIG. 8 shows an embodiment of a fluid heating system incorporating a tubeless heat exchanger entirely disposed within the pressure vessel. Hot combustion gas from the burner (not shown) are directed through an inlet 124 into a conduit 214 into the heat exchanger inlet 224 located on the inner casing 504 to exit at an outlet 236. The primary Heating Surfaces comprise the inner casing 504, the outer casing 502, the heat exchanger top head 808, and bottom head 803. Production fluid is forced under pressure into the pressure vessel inlet 234 where it flows through the pressure vessel 802 with top head 804 and exits the outlet 244. The exterior tubeless heat exchanger core is entirely immersed in production fluid. Since the tubeless heat exchanger core is suspended in the pressure vessel surrounded by production fluid, a region 805 is formed that allows for the collection of debris away from the Heating Surfaces. Debris, such as corrosion products or precipitates, can collect, thereby avoiding the formation of an accumulation of debris adjacent to a heat transfer surface. While not wanting to be bound by theory, it is understood that an accumulation of debris can form an insulating barrier, resulting in thermal gradients or local hotspots which can lead to material failure. The debris region 805 is disposed between the heat exchanger core 806 and the pressure vessel 802. The debris region can be provided in any suitable location that will permit the debris to accumulate under the force of gravity. In an embodiment, the debris region is between the bottom head 803 and pressure vessel shell 804.

Figure 9A:
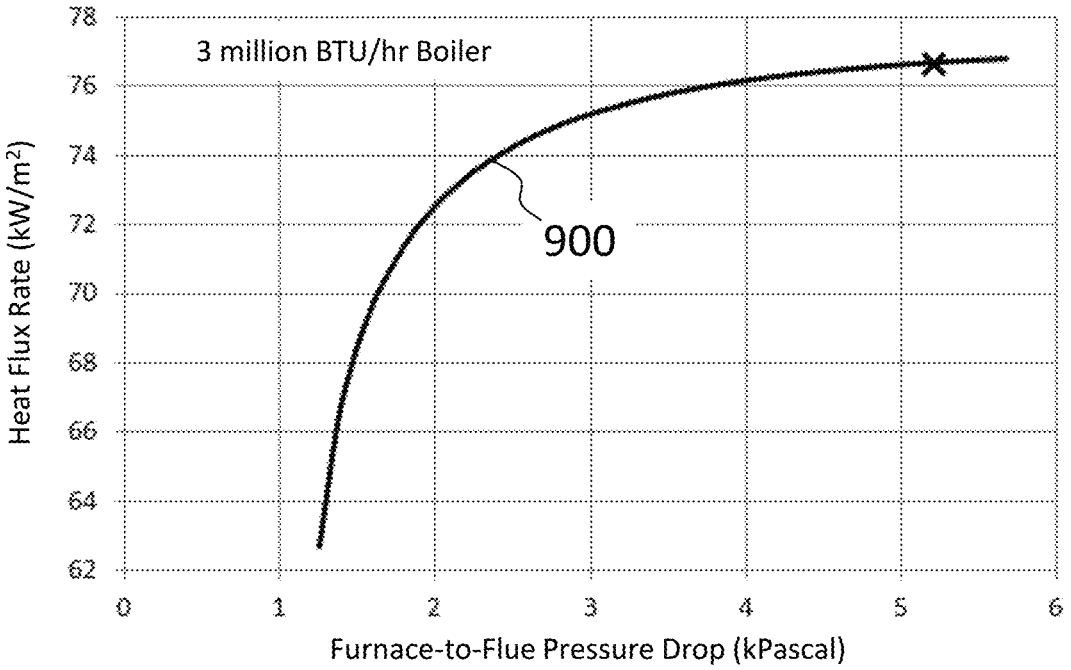
FIG. 9A is a graph showing the relationship between the heat flux rate as a function of furnace-to-flue pressure drop for a 3,000,000 British Thermal Unit/hour (BTU/hr) high pressure shell-and-tube fluid heating system in accordance with embodiments of the present disclosure.
Figure 9B:
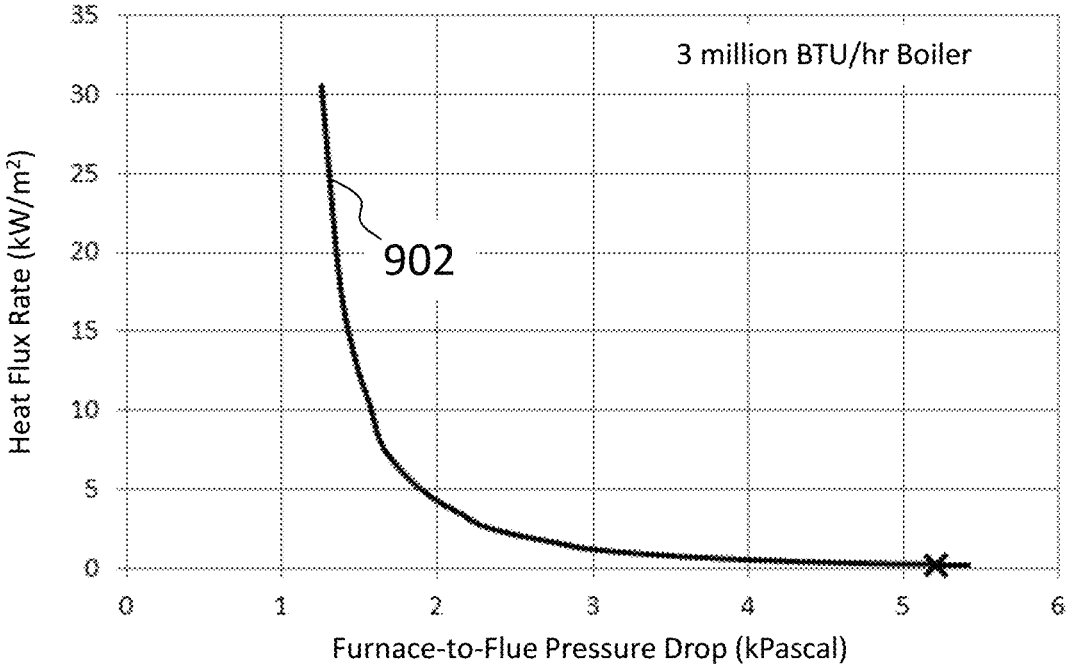
FIG. 9B is a graph showing the differential heat flux rate as a function of furnace-to-flue pressure drop for a 3,000,000 BTU/hr high pressure shell-and-tube fluid heating system in accordance with embodiments of the present disclosure.

Computer modeling and simulations were performed to demonstrate aspects of several boiler configurations. Computer modeling and simulation enable a direct comparison of the boilers of different sizes and configurations at similar thermodynamic and operational conditions. FIG. 9A shows the relationship between heat flux (Q) as a function of furnace-to-flue pressure drop (P) for a simulated 3,000,000 BTU/hr high pressure vertical fluid heating system incorporating a tube-and-shell heat exchanger configured for steam production fluid. FIG. 9B shows the differential (formally, d(d(dQ/dt)dA)/dP) heat flux (derivative of the time rate of the heat flux, Q, per unit area with respect to furnace-to-flue pressure drop, P) for the same simulated boiler system, illustrating that the rate of improvement in heat flux increases rapidly with increasing furnace-to-flue pressure drop until approximately 5 kPa where it begins to asymptote. Further increases in pressure drop past this point produce little improvement in bulk heat flux. All commercially known commercial boiler designs in operation prior to the inventors' discovery operate at a heat flux and furnace-to-flue pressure design point below the inflection point. The embodiments described herein enable operation above the critical point where high heat flux begins to asymptote to exploit greater thermal efficiency without loss of boiler life, reliability, or total energy efficiency.

It is surprising that the heat flux vs. furnace-to-flue pressure drop curve is steep out to values of 3-5 kPa. Current industry practice is to design well below the inflection point—typically, 1.5 kPa—despite the fact that considerable improvements can be realized from operation at higher pressures. Also, near the inflection point, the performance improvements available are substantial in both thermodynamic characteristics and the potential for unit size reduction due to higher power densities available.

However, several obstacles are present at these higher power densities. First, the Bulk Heat Fluxes shown represent the averages of all heat flows through all heated surface areas. Concentrated local heat fluxes can produce local hot spots in certain components causing high stresses and the potential for material failures.

Second, since heat flux is proportional to both the difference in temperature between the production fluid and the thermal transfer fluid and the heat transfer coefficient on the gas side of the heat exchanger surface, fluid heating systems designs must manage the local surface heat transfer rates to maintain local heat flux conditions below failure thresholds.

Third, for steam boilers, designs must limit local conditions to prevent the transition to film boiling, which is not typically a consideration with fuel fired boilers but can be present when the power density is increased by enhancing the furnace-to-flue pressure drop. This is one example of a heat flux consideration that has caused the industry to teach away from higher pressures in the past.

Fourth, for hydronic boilers, boiling at low flow conditions must be managed, particularly in local hot spots like areas surrounding the heat exchanger tubes. As a result, careful layout of the water management path is critical, which in other products is almost irrelevant to the performance and longevity of a standard boiler.

Figure 9C:
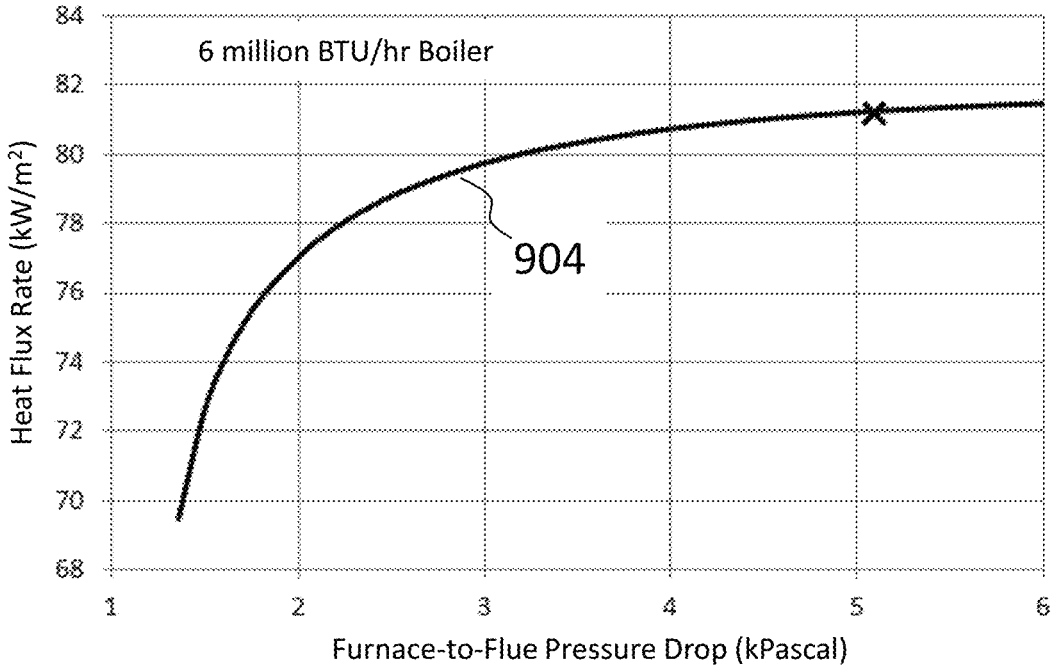
FIG. 9C is a graph showing the relationship between the heat flux rate as a function of furnace-to-flue pressure drop for a 6,000,000 BTU/hr high pressure shell-and-tube fluid heating system in accordance with embodiments of the present disclosure.
Figure 9D:
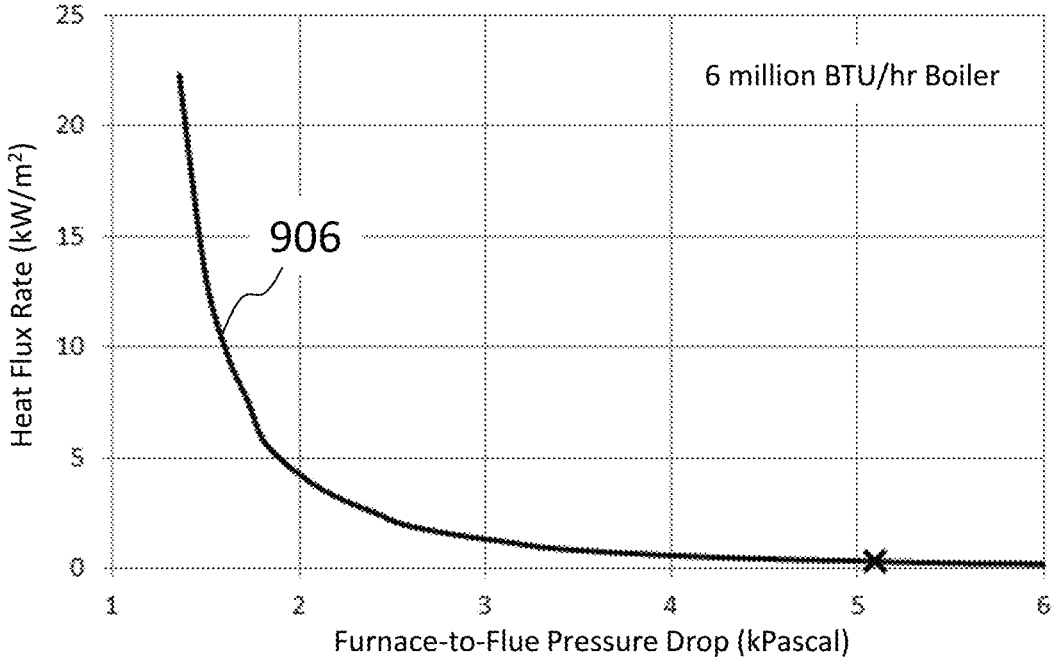
FIG. 9D is a graph showing the differential heat flux rate as a function of furnace-to-flue pressure drop for a 6,000,000 BTU/hr high pressure shell-and-tube fluid heating system in accordance with embodiments of the present disclosure.

Analogous results are shown in FIG. 9C and FIG. 9D for a numerical simulation of a 6,000,000 BTU/hr high pressure vertical fluid heating system incorporating a tube-and-shell heat exchanger configured for steam production fluid. As before, computer simulation verify that the heat flux increases rapidly with furnace-to-flue pressure for values below a critical point, then the curve asymptotes after approximately 5 kPa. Further increases in pressure drop past this point produce little improvement in bulk heat flux.

Figure 9E:
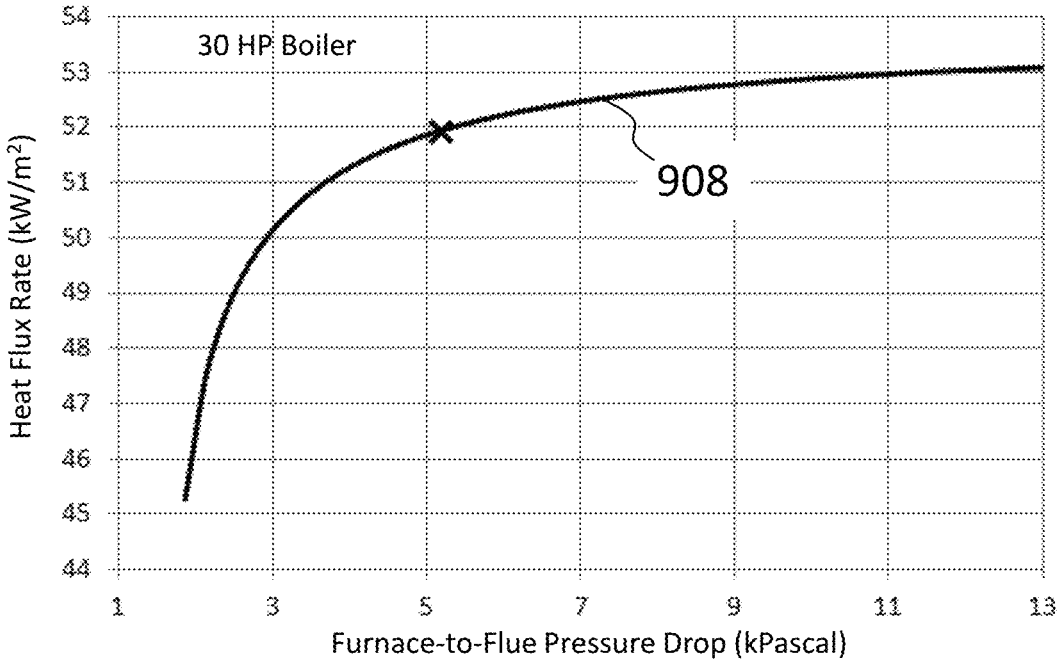
FIG. 9E is a graph showing the relationship between the heat flux rate as a function of furnace-to-flue pressure drop for a 30 horsepower (HP) high pressure spiral ribbed tubeless fluid heating system in accordance with embodiments of the present disclosure.
Figure 9F:
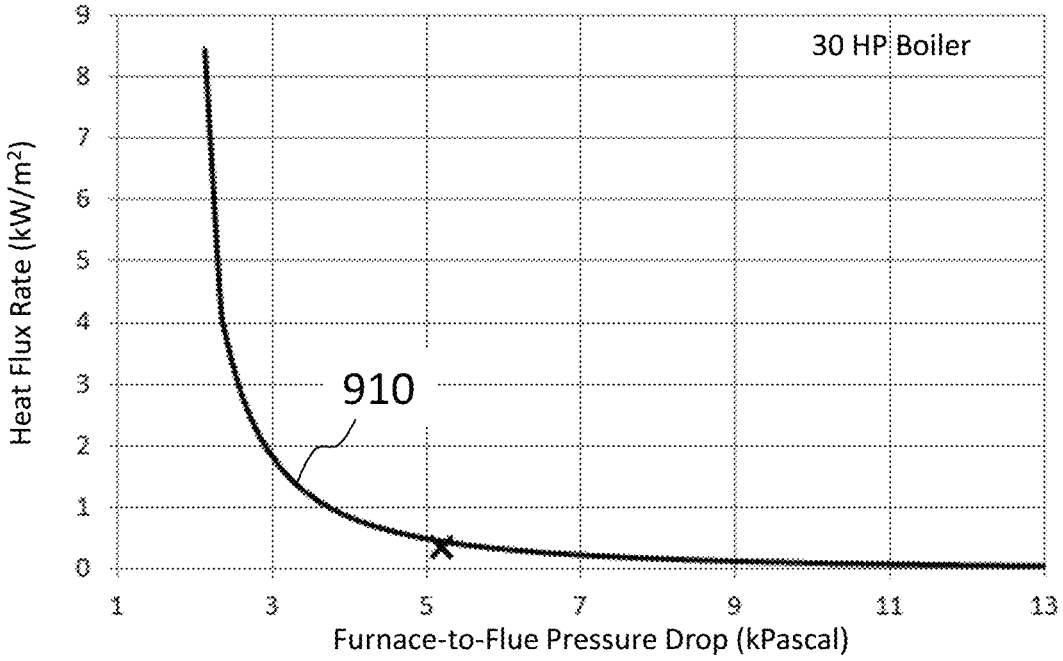
FIG. 9F is a graph showing the differential heat flux rate as a function of furnace-to-flue pressure drop for a 30 HP high pressure spiral ribbed tubeless fluid heating system in accordance with embodiments of the present disclosure.

Analogous results are obtained for a numerical simulation of a 30 HP high pressure vertical fluid heating system incorporating a tubeless exchanger configured for hydronic production fluid as shown in FIG. 9E and FIG. 9F. Again computer simulation verifies that the heat flux increases rapidly with furnace-to-flue pressure for values below a critical point, then the curve asymptotes after approximately 5 kPa. Further increases in pressure drop past this point produce little improvement in bulk heat flux.

The simulated test shows that while the specific point selected varies in pressure drop, in all cases the design point selected is in the range where the differential is reduced below 1. Thus, heat flux rapidly increases with increasing furnace-to-flue pressure drop until a certain point, after which additional pressure drop does very little to improve heat flux. From the differential plots show that, in the range of boiler sizes typical for commercial applications, the inflection point occurs at 5 kPa or greater.

Tests have also been conducted by the inventors to verify operational aspects of the disclosed systems. Table 1 shows operational test data for a 3,000,000 BTU/hr high pressure vertical fluid heating system incorporating a tube-and-shell heat exchanger configured for steam production fluid, as described in FIG. 9A and FIG. 9B.

TABLE 1

| 3 million BTU/hr | | | | |
|---|---|---|---|---|
| | Value | Units | Value | Units |
| Furnace Pressure | 25.70 | Inches of water column (w.c.) | 6.40 | Kilopascal (kPa) |
| Flue Pressure | 0.12 | w.c. | 0.03 | kPa |
| Furnace-to-Flue Pressure | 25.58 | w.c. | 6.37 | kPa |
| BTS Thermal Efficiency | 96.30 | % | 96.3 | % |
| Boiler Input | 3,000,000 | BTU/hr | 878 | Kilowatts (kW) |
| Boiler Output | 2,889,000 | BTU/hr | 846 | kW |
| Blower Current Draw | 7.63 | Amperes | 7.63 | Amperes |
| Blower Consumed Power | 6.055 | kW | 6.055 | kW |
| Total Consumed Power | | kW | 6,934 | kW |
| Total Wetted Surface Area | 116.00 | Feet squared ($ft^2$) | 10.78 | Meters squared ($m^2$) |
| Bulk Heat Flux | 24,905 | $BTU/hr/ft^2$ | 77.26 | $kW/m^2$ |

Table 2 shows the results of an operational test of a 6,000,000 BTU/hr high pressure vertical fluid heating system incorporating a tube-and-shell heat exchanger configured for steam production fluid as described in FIGS. 9C and 9D These data show the higher power density resulting from the enhanced heat flux rate resulting from increasing the furnace-to-flue pressure scales effectively with size, dimension, and capacity of the boiler as predicted by the computer simulation results.

TABLE 2

| 6 million BTU/hr | | | | |
|---|---|---|---|---|
| | Value | Units | Value | Units |
| Furnace Pressure | 24.10 | w.c. | 6.00 | kPa |
| Flue Pressure | 0.23 | w.c. | 0.06 | kPa |
| Furnace-to-Flue Pressure | 23.87 | w.c. | 5.94 | kPa |
| BTS Thermal Efficiency | 94.70 | % | 94.70 | % |

TABLE 2-continued

| 6 million BTU/hr | | | | |
|---|---|---|---|---|
| | Value | Units | Value | Units |
| Boiler Input | 6,000,000 | BTU/hr | 1,758 | kW |
| Boiler Output | 5,682,000 | BTU/hr | 1,665 | kW |
| Blower Current Draw | 14.20 | Amperes | 14.20 | Amperes |
| Blower Consumed Power | 8.70 | kW | 8.70 | kW |
| Total Consumed Power | | kW | 1,766 | kW |
| Total Wetted Surface Area | 220.00 | $ft^2$ | 20.44 | $m^2$ |
| Bulk Heat Flux | 25,827 | $BTU/hr/ft^2$ | 81.44 | $kW/m^2$ |

Table 3 shows operational test data for an instrumented 30 HP high pressure vertical fluid heating system incorporating a spiral ribbed tubeless heat exchanger configured for hydronic production fluid, as described FIG. 9E and FIG. 9F. These data verify that the higher power density resulting from the enhanced heat flux rate resulting from increasing the furnace-to-flue pressure is also present in a boiler configured with a tubeless heat exchanger.

TABLE 3

| 30 HP BTU/hr | | | | |
|---|---|---|---|---|
| | Value | Units | Value | Units |
| Furnace Pressure | 21.50 | w.c. | 5.35 | kPa |
| Flue Pressure | 0.15 | w.c. | 0.04 | kPa |
| Furnace-to-Flue Pressure | 21.35 | w.c. | 5.31 | kPa |
| BTS Thermal Efficiency | 84.50 | % | 84.5 | % |
| Boiler Input | 1,200,00 | BTU/hr | 352 | kW |
| Boiler Output | 1,014,000 | BTU/hr | 297 | kW |
| Blower Current Draw | 4.05 | Amperes | 4.05 | Amperes |
| Blower Consumed Power | 1.59 | kW | 1.59 | kW |
| Total Consumed Power | | kW | 353 | kW |
| Total Wetted Surface Area | 61.00 | $ft^2$ | 5.67 | $m^2$ |
| Bulk Heat Flux | 16,623 | $BTU/hr/ft^2$ | 58.77 | $kW/m^2$ |

Table 4 shows certification test data for an instrumented 30 HP high pressure vertical hydronic boiler product incorporating a spiral ribbed tubeless heat exchanger configured for hydronic production fluid, corresponding to the prototype test rig described FIG. 9E and FIG. 9F. Again, the certification test data verify that the higher power density resulting from the enhanced heat flux rate resulting from increasing the furnace-to-flue pressure is also present in a boiler configured with a tubeless heat exchanger.

TABLE 4

| 30 HP BTU/hr | | |
|---|---|---|
| | Value | Units |
| Wetted Surface Area | 61 | ft^2 |
| Heat Output (from Rating) | 1,004,250 | BTU/Hr |
| Blower Discharge | 0.79431 | psi |
| Burner Pressure Drop | 0.072201 | psi |
| Furnace-to-Flue Pressure Drop | 0.7221 | psi |
| Bulk Heat Flux | 16,463.1 | BTU/Hr/ft^2 |

These data can be used to calculate the Bulk Heat Flux as displayed on FIG. 2 as follows:

First, calculate $q_{in}$:

$$q_{in}=V_{total\ gas}*C_{gas\ meas}*\text{CalVal}=1269.2\ ft^3*1.8745*1010.735\ \text{BTU/SCF}=2{,}404{,}655\ \text{BTU}$$

Calculate Sensible Heat according to the AHRI BTS-2000:

$$q_s=\frac{C_p*W*(T_{sat}-T_{ln})}{t_T}=\frac{1\ \text{btu/lbR}*1889.4\ \text{lbs}*(217.24^\circ\ \text{F.}-77.2^\circ\ \text{F.})}{2\ \text{hrs}}=132345.45\ \text{BTU/Hr}$$

Calculate the Latent Heat per AHRI BTS-2000:

$$q_l=\frac{h_{fg}*(W-W_s)}{t_T}=\frac{966.88\ \text{btu/lb}*(1889.4\ \text{lb}-66.757)}{2\ \text{hrs}}=881155.28\ \text{BTU/Hr}$$

Calculate the Total Heat Output Rate $$q_{out}=q_s+q_l=1{,}013{,}500\frac{\text{BTU}}{\text{Hr}}=q_{production\ fluid}$$

Next, calculate the total area for heated surfaces using geometrical formulas for the components:

$A$=61 ft^2

Finally, calculate Bulk Heat Flux:

$$q''=\frac{q_{production\ fluid}}{\text{Area}}=\frac{1013500\frac{\text{BTU}}{\text{Hr}}}{61\ ft^2}=\frac{16614.75\frac{\text{BTU}}{\text{Hr}}}{ft^2}$$

Figure 10A:
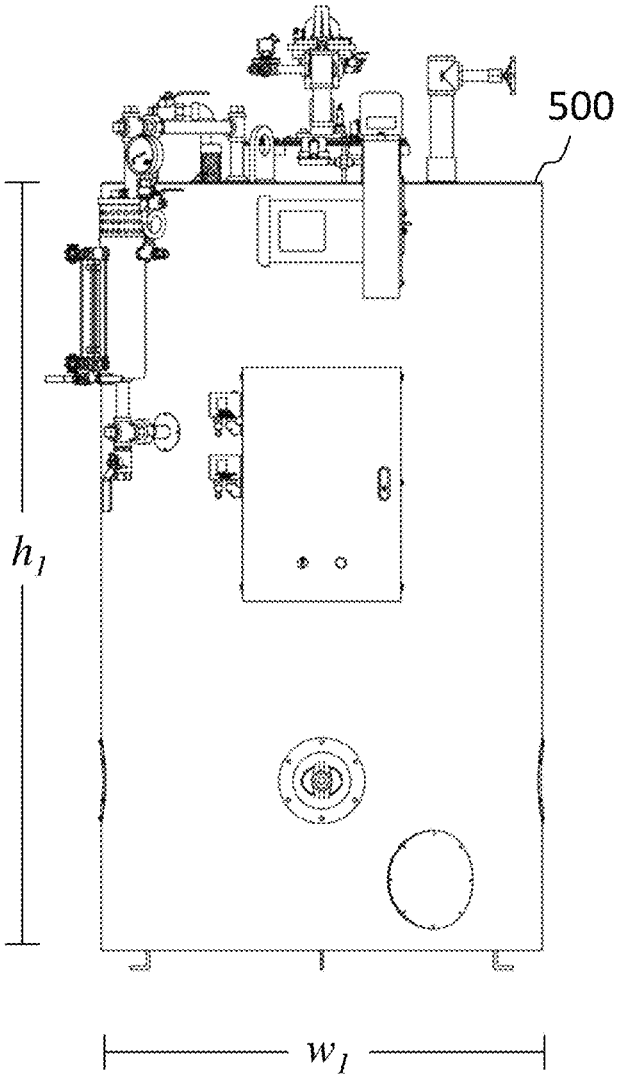
FIG. 10A shows a perspective view of a vertical boiler in accordance with embodiments of the present disclosure.
Figure 10B:
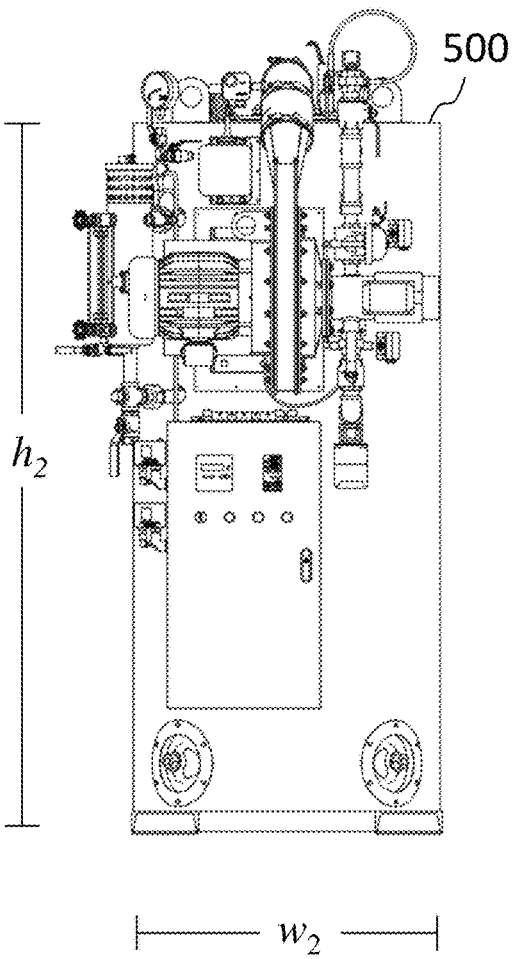
FIG. 10B shows a perspective view of a high pressure vertical boiler in accordance with embodiments of the present disclosure.

FIG. 10 illustrates improvement in unit footprint and volume that results from the described systems. FIG. 10A shows a perspective drawing of a standard hydronic fluid heating system including the body cover 500 that contains the pressure vessel, heat exchanger and conduits with height, $h_1$, and width $w_1$. FIG. 10B shows a perspective drawing of a high pressure hydronic fluid heating system with body cover 500 height, $h_2$, and width $w_2$. The increased power density resulting from the enhanced bulk heat flux due to the higher furnace-to-flue pressure drop enables a substantial reduction in the dimensions of the fluid heating system, typically reducing the volume of a unit by 20 to 30% compared with a standard system with the same production capacity and performance.

EMBODIMENTS

In an embodiment, disclosed is a fluid heating system comprising: a pressure vessel comprising a first inlet and first outlet and an inside and an outside; an assembly comprising: a heat exchanger core comprising a second inlet and a second outlet, and an inner surface and an outer surface, wherein the heat exchanger core is inside the pressure vessel; a first conduit having a first end connected to the second inlet of the heat exchanger core and a second end disposed outside of the pressure vessel; a second conduit having a first end connected to the second outlet of the heat exchanger core and a second end disposed outside of the pressure vessel; and a blower in fluid connection with the first conduit, the blower configured for forcing a gas under pressure through the assembly; wherein the heat exchanger core further comprises a flow passage between the second inlet and the second outlet, wherein the flow passage is configured to contain a thermal transfer fluid; wherein the fluid heating system satisfies the condition that a Bulk Heat Flux between the first end of the first conduit and the first end of the second conduit is between 45 $kW/m^2$ and 300 $kW/m^2$ wherein Bulk Heat Flux is determined by dividing the Gross Output by the Total Heating Surface Area where the Gross Output is determined in accordance with Section 11.1.12 of the AHRI BTS-2000, and the Total heated Surface Area is calculated by summing all of the heat transfer surfaces that are directly exposed to thermal transfer fluid, and wherein the Pressure Drop between the first end of the first conduit and the first end of the second conduit is between 3 kiloPascals and 30 kiloPascals.

Also disclosed is method of heat transfer, the method comprising: providing a fluid heating system comprising a pressure vessel comprising an inside and an outside and a first inlet and a first outlet; a heat exchanger core comprising a second inlet and a second outlet, wherein the heat exchanger core is inside the pressure vessel; a first conduit having a first end connected to the second inlet of the heat exchanger core and a second end disposed outside of the pressure vessel; a second conduit having a first end connected to the second outlet of the heat exchanger core and a second end disposed outside of the pressure vessel; a blower disposed in the first conduit; and disposing a thermal transfer fluid in the heat exchanger core and a production fluid between the inside of the pressure vessel and the heat exchanger core to transfer heat from the thermal transfer fluid to the production fluid wherein the fluid heating system has a Bulk Heat Flux between the first end of the first conduit and the first end of the second conduit between 45 kW/m2 and 300 kW/m2 wherein Bulk Heat Flux is determined by dividing the Gross Output by the Total Heated Surface Area where the Gross Output is determined in accordance with Section 11.1.12 of the AHRI BTS-2000, and the Total heated Surface Area is calculated by summing all of the heat transfer surfaces that are directly exposed to thermal transfer fluid, and wherein the Pressure Drop between the first end of the first conduit and the first end of the second conduit is between 3 kiloPascals and 30 kiloPascals.

In an embodiment, disclosed is a method of manufacturing a fluid heating system, the method comprising: providing a pressure vessel comprising a first inlet and a first outlet and an inside and an outside; disposing a heat exchanger core entirely in the pressure vessel, the heat exchanger core comprising a second inlet and a second outlet; connecting the second inlet of the heat exchanger core to a first conduit, which extends outside the pressure vessel; and connecting the second outlet of the heat exchanger core to a second conduit, which extends outside the pressure vessel.

In an embodiment, disclosed is A fluid heating system comprising: a pressure vessel comprising a first inlet and first outlet and an inside and an outside, wherein the pressure vessel is configured to contain a production fluid comprising liquid water, steam, a C1 to C10 hydrocarbon, a thermal fluid, a thermal oil, a glycol, air, carbon dioxide, carbon monoxide, or a combination thereof; a tube heat exchanger core comprising a first tube sheet, a second tube sheet, a plurality of heat exchanger tubes, each heat exchanger tube independently connecting the first tube sheet and the second tube sheet, a second inlet disposed on the first tube sheet, a second outlet disposed on the second tube sheet, wherein the first inlet and second outlet define a flow passage, and wherein the tube heat exchanger core is configured to contain a gas phase thermal transfer fluid in the flow passage of the heat exchanger core, wherein the thermal transfer fluid comprises water, a substituted or unsubstituted C1 to C30 hydrocarbon, air, carbon dioxide, carbon monoxide, combustion byproducts, a thermal fluid, a thermal oil, a glycol or a combination thereof; a first conduit having a first end connected to the second inlet of the heat exchanger core and a second end disposed outside of the pressure vessel; a second conduit having a first end connected to the second outlet of the heat exchanger core and a second end disposed outside of the pressure vessel; and, a blower for forcing the thermal transfer fluid under pressure through an assembly comprising the first conduit, the heat exchanger and the second conduit wherein the blower is in fluid communication with the first conduit the first conduit further comprises a burner assembly and a furnace assembly disposed in the first conduit; wherein the fluid heating system satisfies the condition that a Bulk Heat Flux between the first end of the first conduit and the first end of the second conduit is between 47 kW/m2 and 120 kW/m2 wherein Bulk Heat Flux is determined by dividing the Gross Output by the Total Heating Surface Area where the Gross Output is determined in accordance with Section 11.1.12 of the AHRI BTS-2000, and the Total heated Surface Area is calculated by summing all of the heat transfer surfaces that are directly exposed to thermal transfer fluid, and wherein the Pressure Drop between the first end of the first conduit and the first end of the second conduit is between than 3 kiloPascals and 12 kiloPascals.

In an embodiment, disclosed is A fluid heating system comprising: a pressure vessel comprising a first inlet and first outlet and an inside and an outside, wherein the pressure vessel is configured to contain a production fluid comprising liquid water, steam, a C1 to C10 hydrocarbon, a thermal fluid, a thermal oil, a glycol, air, carbon dioxide, carbon monoxide, or a combination thereof; a tubeless heat exchanger core comprising a top head, a bottom head, an inner casing disposed between the top head and the bottom head, the inner casing comprising an inner surface, an outer casing disposed between the top head and the bottom head and opposite the inner surface of the inner casing, a first inlet and a second inlet on the inner casing, the outer casing, or a combination thereof, and a first outlet and a second outlet on the inner casing, the outer casing, or combination thereof, wherein at least one of the inner casing and the outer casing comprises a rib, a ridge, a spine, or a combination thereof wherein the inner casing and the outer casing define a flow passage between the inlet and the outlet of the tubeless heat exchanger core, and wherein the flow passage is configured to contain a gas phase thermal transfer fluid in the flow passage of the heat exchanger core, wherein the thermal transfer fluid comprises water, a substituted or unsubstituted C1 to C30 hydrocarbon, air, carbon dioxide, carbon monoxide, combustion byproducts, a thermal fluid, a thermal oil, a glycol or a combination thereof; a first conduit having a first end connected to the second inlet of the heat exchanger core and a second end disposed outside of the pressure vessel; a second conduit having a first end connected to the second outlet of the heat exchanger core and a second end disposed outside of the pressure vessel; and, a blower for forcing the gas phase thermal transfer fluid under pressure through the first conduit, the heat exchanger and the second conduit wherein the blower is in fluid communication with the first conduit the first conduit further comprises a burner assembly disposed in the first conduit and the first conduit further comprises a furnace assembly disposed in the first conduit; wherein the fluid heating system satisfies the condition that a Bulk Heat Flux between the first end of the first conduit and the first end of the second conduit is between 47 kW/m2 and 120 kW/m2 wherein Bulk Heat Flux is determined by dividing the Gross Output by the Total Heating Surface Area where the Gross Output is determined in accordance with Section 11.1.12 of the AHRI BTS-2000, and the Total heated Surface Area is calculated by summing all of the heat transfer surfaces that are directly exposed to thermal transfer fluid, and wherein the Pressure Drop between the first end of the first conduit and the first end of the second conduit is between 3 kiloPascals and 12 kiloPascals.

In any of the various embodiments, the heat exchanger core may be a tubeless heat exchanger core; and/or the heat exchanger core may be a tube heat exchanger core; and/or the heat exchanger core may have a hydrodynamic diameter of 1.25 centimeters to 100 centimeters; and/or the heat exchanger core may have an average hydrodynamic diameter of 1.25 centimeters to 100 centimeters; and/or the pressure vessel may be configured to contain a production fluid; and/or the production fluid may comprise water, a substituted or unsubstituted C1 to C30 hydrocarbon, air, carbon dioxide, carbon monoxide, a thermal fluid, a thermal oil, a glycol, or a combination comprising at least one of the foregoing; and/or the heat exchanger core further may comprise a flow passage between the second inlet and the second outlet, wherein the flow passage is configured to contain a thermal transfer fluid; and/or the thermal transfer fluid may comprise a gaseous or non-gaseous fluid; and/or the thermal transfer fluid may comprise water, a substituted or unsubstituted C1 to C30 hydrocarbon, air, carbon dioxide, carbon monoxide, a thermal fluid, a thermal oil, a glycol or a combination thereof; and/or the flow passage may be contained entirely inside of the pressure vessel; and/or the heat exchanger core may be a tubeless heat exchanger core and comprise a top head, a bottom head, an inner casing disposed between the top head and the bottom head, the inner casing comprising an inner surface, an outer casing disposed between the top head and the bottom head and opposite the inner surface of the inner casing, a third inlet on the inner casing, the outer casing, or a combination thereof, and a third outlet on the inner casing, the outer casing, or combination thereof, wherein at least one of the inner casing and the outer casing comprises a rib, a ridge, or a combination thereof wherein the inner casing and the outer casing may define a flow passage between the third inlet and the third outlet of the tubeless heat exchanger core; and/or the inner casing may be coaxial with the outer casing; and/or at least one of the inner casing and the outer casing may have a thickness of 0.5 centimeters to 5 centimeters; and/or optionally configured to contain a production fluid between the inside of the pressure vessel and the outer surface of the heat exchanger core, wherein the production fluid contacts the entirety of the outer surface of the heat exchanger core, wherein the production fluid comprises a liquid, a gas, or a combination thereof, and optionally configured to contain a gaseous thermal transfer fluid in the flow passage of the heat exchanger core; and/or the production fluid may comprise liquid water, steam, a thermal fluid, a thermal oil, a glycol, or a combination thereof; and/or the first conduit may further comprises a burner assembly disposed in the first conduit; the first conduit may further comprises a furnace assembly comprising an inlet and an outlet disposed in the first conduit; and the second conduit may further comprises an exhaust flue comprising an inlet and an outlet disposed in the second conduit; and/or the thermal transfer fluid may be a combustion gas from the burner assembly; and/or the Pressure Drop between the furnace assembly inlet and the exhaust flue inlet may be between 3 kiloPascals and 30 kiloPascals; and/or a Bulk Heat Flux between the furnace assembly outlet and the exhaust flue inlet may be between 45 kW/m2 and 300 kW/m2 wherein Bulk Heat Flux is determined by dividing the Gross Output by the Total Heating Surface Area where the Gross Output is determined in accordance with Section 11.1.12 of the AHRI BTS-2000, and the Total heated Surface Area is calculated by summing all of the heat transfer surfaces that are directly exposed to thermal transfer fluid; and/or the furnace assembly may be directly connected to the heat exchanger core; and/or the blower may not be present between the furnace assembly and the heat exchanger core; and/or the method may further comprise directing the production fluid from the first inlet to the first outlet to provide a flow of the production fluid through the pressure vessel, and directing the thermal transfer fluid from the second inlet to the second outlet to provide a flow of the thermal transfer fluid through a flow passage between the second inlet and the second outlet of the heat exchanger core, wherein the flow passage is configured to contain a thermal transfer fluid in the heat exchanger core; and/or the production fluid may comprise liquid water, steam, a C1 to C10 hydrocarbon, a thermal fluid, a thermal oil, a glycol, air, carbon dioxide, carbon monoxide, or a combination thereof; and/or the production fluid may comprise liquid water, steam, or a combination thereof; and/or the blower may be in fluid communication with the first conduit; the first conduit further may comprise a burner assembly disposed in the first conduit; may comprise the first conduit further comprises a furnace assembly disposed in the first conduit, wherein the furnace assembly comprises a furnace inlet and a furnace outlet; and the second conduit may further comprises an exhaust flue assembly comprising an inlet and an outlet disposed in the second conduit, wherein the fluid heating system has a Bulk Heat Flux between the furnace outlet and the exhaust flue inlet between 45 kW/m2 and 300 kW/m2 wherein Bulk Heat Flux is determined by dividing the Gross Output by the Total Heated Surface Area where the Gross Output is determined in accordance with Section 11.1.12 of the AHRI BTS-2000, and the Total heated Surface Area is calculated by summing all of the heat transfer surfaces that are directly exposed to thermal transfer fluid; and/or the method may further comprise directing the production fluid from the first inlet to the first outlet to provide a flow of the production fluid through the pressure vessel, and directing the thermal transfer fluid from the second inlet to the second outlet to provide a flow of the thermal transfer fluid through a flow passage between the second inlet and the second outlet of the heat exchanger core, wherein the flow passage is configured to contain a thermal transfer fluid in the heat exchanger core; and/or the production fluid may comprise liquid water, steam, a C1 to C10 hydrocarbon, a thermal fluid, a thermal oil, a glycol, air, carbon dioxide, carbon monoxide, or a combination thereof; and/or the production fluid may comprise liquid water, steam, or a combination thereof; and/or the thermal transfer fluid may be a combustion gas from the burner assembly; and/or optionally further comprising generating the combustion gas by directing a combustible mixture into the burner assembly and combusting the combustible mixture to produce the combustion gas; and/or optionally further comprising pressurizing a combustible mixture with the blower, which blower is in fluid communication with the second end of the conduit; and/or the heat exchanger core maybe tubeless; and/or the heat exchanger core may further comprise an inner casing having an inner surface and an outer surface, and wherein the second inlet is disposed on an outer surface of the inner casing of the heat exchanger core.

The systems and methods have been described with reference to the accompanying drawings, in which various embodiments are shown. This disclosure may, however, be embodied in many different forms, and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements can be present therebetween. In contrast, when an element is referred to as being "directly on" or "directly connected" or other terms or connection or attachment with another element, there are no intervening elements present. Also, the element can be on an outer surface or on an inner surface of the other element, and thus "on" can be inclusive of "in" and "on."

It will be understood that, although the terms "first," "second," "third," etc. can be used herein to describe various elements, components, regions, layers, and/or sections, these elements, components, regions, layers, and/or sections should not be limited by these terms. These terms are only used to distinguish one element, component, region, layer, or section from another element, component, region, layer or section. Thus, "a first element," "component," "region," "layer," or "section" discussed below could be termed a second element, component, region, layer, or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes," and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," can be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

"Hydrocarbon" means an organic compound having at least one carbon atom and at least one hydrogen atom, wherein one or more of the hydrogen atoms can optionally be substituted by a halogen atom (e.g., $CH_3F$, $CHF_3$ and $CF_4$ are each a hydrocarbon as used herein)

"Substituted" means that the compound is substituted with at least one (e.g., 1, 2, 3, or 4) substituent independently selected from a hydroxyl (—OH), a C1-9 alkoxy, a C1-9 haloalkoxy, an oxo (=O), a nitro ($—NO_2$), a cyano (—CN), an amino ($—NH_2$), an azido ($—N_3$), an amidino (—C(=NH)$NH_2$), a hydrazino ($—NHNH_2$), a hydrazono ($=N—NH_2$), a carbonyl (—C(=O)—), a carbamoyl group (—C(O)$NH_2$), a sulfonyl ($—S(=O)_2—$), a thiol (—SH), a thiocyano (—SCN), a tosyl ($CH_3C_6H_4SO_2—$), a carboxylic acid (—C(=O)OH), a carboxylic C1 to C6 alkyl ester (—C(=O)OR wherein R is a C1 to C6 alkyl group), a carboxylic acid salt (—C(=O)OM) wherein M is an organic or inorganic anion, a sulfonic acid ($—SO_3H_2$), a sulfonic mono- or dibasic salt ($—SO_3MH$ or $—SO_3M_2$ wherein M is an organic or inorganic anion), a phosphoric acid ($—PO_3H_2$), a phosphoric acid mono- or dibasic salt ($—PO_3MH$ or $—PO_3M_2$ wherein M is an organic or inorganic anion), a C1 to C12 alkyl, a C3 to C12 cycloalkyl, a C2 to C12 alkenyl, a C5 to C12 cycloalkenyl, a C2 to C12 alkynyl, a C6 to C12 aryl, a C7 to C13 arylalkylene, a C4 to C12 heterocycloalkyl, and a C3 to C12 heteroaryl instead of hydrogen, provided that the substituted atom's normal valence is not exceeded.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat can, typically, have rough and/or nonlinear features. Moreover, sharp angles that are illustrated can be rounded. Thus, the regions illustrated in the figures are schematic in nature and their shapes are not intended to illustrate the precise shape of a region and are not intended to limit the scope of the present claims.

What is claimed is:

1. A fluid heating system for heating a production fluid using a thermal transfer fluid, the production fluid being contained in a vessel, comprising:

an electric blower configured to receive ambient air and electrical input power and to provide output source air;

a combustion system configured to receive the source air from the electric blower and to receive fuel and to provide the thermal transfer fluid at a combustion system exit;

a heat exchanger configured to receive the thermal transfer fluid from the combustion system exit and configured to be in thermal communication with the production fluid to provide convective heat exchange from the thermal transfer fluid to the production fluid, and to provide output exhaust gas to an exhaust flue having an exhaust flue inlet; and wherein the electric blower provides a predetermined volume flow rate of the output source air at a predetermined blower efficiency such that the fluid heating system has a Bulk Heat Flux of at least about 14.7 kBTU/Hr/ft$^2$ and a Pressure Drop of at least about 0.7 psi, wherein the Pressure Drop is measured from the combustion system exit to the exhaust flue inlet.

2. The system of claim 1, wherein the blower efficiency is at least about 32%.

3. The system of claim 1, wherein the electric blower provides a static pressure of at least about 6,800 Pa.

4. The system of claim 1, wherein the output source air provided by the electric blower has a volume flow rate of at least about 0.05 m$^3$/sec.

5. The system of claim 1, wherein the electric blower consumes less than about 2 kW electrical power.

6. The system of claim 1, wherein the Bulk Heat Flux is at least about 16.623 kBTU/Hr/ft$^2$ and the Pressure Drop is at least about 0.77 psi.

7. The system of claim 1 wherein the heat exchanger comprises at least one of a sheet and tube heat exchanger and a tubeless heat exchanger.

8. The fluid heating system of claim 1, wherein the thermal transfer fluid comprises a gaseous or non-gaseous fluid.

9. The fluid heating system of claim 1, wherein the heat exchanger is contained entirely inside of the vessel.

10. The fluid heating system of claim 1, wherein the production fluid comprises liquid water, steam, a thermal fluid, a thermal oil, a glycol, or a combination thereof.

11. The fluid heating system of claim 1, wherein the combustion system is configured to be in thermal communication with the production fluid to provide additional convective heating of the production fluid.

12. A method of heating a production fluid using a thermal transfer fluid, the production fluid being contained in a vessel, comprising:

providing a fluid heating system, comprising: an electric blower configured to receive ambient air and electrical input power and to provide output source air; a combustion system configured to receive the source air from the electric blower and to receive fuel and to provide the thermal transfer fluid at a combustion system exit; and a heat exchanger configured to receive the thermal transfer fluid from the combustion system exit and configured to be in thermal communication with the production fluid to provide convective heat exchange from the thermal transfer fluid to the production fluid, and to provide output exhaust gas to an exhaust flue having an exhaust flue inlet; and providing, by the electric blower, a predetermined volume flow rate of the output source air at a predetermined blower efficiency such that the fluid heating system has a Bulk Heat Flux of at least about 14.7 kBTU/Hr/ft$^2$ and a Pressure Drop of at least about 0.7, wherein the Pressure Drop is measured from the combustion system exit to the exhaust flue inlet.

13. The method of claim 12, wherein the blower efficiency is at least about 32%.

14. The system of claim 12, wherein the electric blower provides a static pressure of at least about 6,800 Pa.

15. The system of claim 12, wherein the output source air provided by the electric blower has a volume flow rate of at least about 0.05 m$^3$/sec.

16. The fluid heating system of claim 12, wherein the combustion system is configured to be in thermal communication with the production fluid to provide additional convective heating of the production fluid.

17. A method of heating a production fluid with a fluid heating system using a thermal transfer fluid, the production fluid being contained in a vessel, comprising:

receiving, by an electric blower, ambient air and electrical input power and providing, by the blower, output source air;

receiving, by a combustion system, the output source air from the electric blower and receiving, by the combustion system, fuel, and providing, by the combustion system, the thermal transfer fluid at a combustion system exit; and receiving, at a heat exchanger, the thermal transfer fluid from the combustion system exit and providing convective heat exchange from the thermal transfer fluid to the production fluid, and providing an output exhaust gas to an exhaust flue having an exhaust flue inlet; and providing, by the electric blower, a predetermined volume flow rate of the output source air at a predetermined blower efficiency such that the fluid heating system has a Bulk Heat Flux of at least about 14.7 kBTU/Hr/ft$^2$ and a Pressure Drop of at least about 0.7, wherein the Pressure Drop is measured from the combustion system exit to the exhaust flue inlet.

18. The method of claim 17, wherein the blower efficiency is at least about 32%.

19. The system of claim 17, wherein the electric blower provides a static pressure of at least about 6,800 Pa.

* * * * *